US007944137B2

(12) United States Patent
Eguchi et al.

(10) Patent No.: US 7,944,137 B2
(45) Date of Patent: May 17, 2011

(54) ELECTRON SOURCE AND IMAGE DISPLAY APPARATUS

(75) Inventors: Shingo Eguchi, Hiratsuka (JP); Yasushi Shimizu, Fujisawa (JP); Noriaki Oguri, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 12/552,840

(22) Filed: Sep. 2, 2009

(65) Prior Publication Data

US 2010/0060126 A1 Mar. 11, 2010

(30) Foreign Application Priority Data

Sep. 9, 2008 (JP) ..... 2008-230765

(51) Int. Cl.
*H01J 1/62* (2006.01)

(52) U.S. Cl. ..... 313/495

(58) Field of Classification Search ..... 313/414, 313/441–460, 495–497, 293–304, 306, 309–310, 313/346, 351, 355; 438/20
See application file for complete search history.

(56) References Cited

U.S. PATENT DOCUMENTS 6,656,007 B2 12/2003 Fushimi et al.
7,145,288 B2 12/2006 Shimizu
2005/0227062 A1 10/2005 Sato et al.

FOREIGN PATENT DOCUMENTS

JP 2002-352699 A 12/2002

*Primary Examiner* — Nimeshkumar D Patel
*Assistant Examiner* — Donald L Raleigh
(74) *Attorney, Agent, or Firm* — Fitzpatrick, Cella, Harper & Scinto

(57) ABSTRACT

There is provided an electron source according to the present invention, having a plurality of electron-emitting devices wherein each of the electron-emitting devices has a pair of electrodes, and a plurality of conductive films having respective electron emitting portions, provided between the pair of electrodes so as to be electrically connected to the pair of electrodes, the electron source including: a short-circuit suppressing film which is positioned between the plurality of conductive films and is provided on the electron-emitting device so as to be electrically connected to the pair of electrodes, and mainly contains tungsten (W) and germanium (Ge) nitride, wherein a ratio of the number of tungsten atoms to the number of tungsten and germanium atoms is 0.24 or more in the short-circuit suppressing film, surface resistivity of the short-circuit suppressing film is not less than $1\times10^{10}$ Ω/square and not more than $1\times10^{13}$ Ω/square.

5 Claims, 17 Drawing Sheets

FIG. 13

| W/(W+Ge) | STABILITY OF ELECTRON EMISSION CHARACTERISTIC |
|---|---|
| 0. 09 | C |
| 0. 2 | C |
| 0. 21 | C |
| 0. 22 | C |
| 0. 23 | B |
| 0. 24 | A |
| 0. 25 | A |
| 0. 3 | A |
| 0. 32 | A |
| 0. 35 | A |

ELECTRON SOURCE AND IMAGE DISPLAY APPARATUS

BACKGROUND OF THE INVENTION

1. Field of the Invention

The present invention relates to an electron source having a plurality of electron-emitting devices and an image display apparatus using the electron source.

2. Description of the Related Art

Electron-emitting devices include field emission and surface conduction electron-emitting devices. A conventional surface conduction electron-emitting device and manufacturing steps thereof are described with reference to FIGS. 16A, 16B and 17A to 17D.

A pair of electrodes 2 and 3 is provided on a substrate 1 (FIG. 17A). The electrodes 2 and 3 are connected by a conductive film 4 (FIG. 17B). A voltage is applied between the pair of electrodes 2 and 3 so that a first gap 7 is formed partially on the conductive film 4 (FIG. 17C). Specifically, an electric current is applied to the conductive film 4 so that Joule heat is generated. The first gap 7 is formed partially on the conductive film 4 with the Joule heat. This process is called energization forming (process). A pair of conductive films 4*a* and 4*b* which is opposed to each other via the first gap 7 is formed by the energization forming process. The device is subject to a process that is called an (energization) activating process. The energization activating process is a process for applying a voltage between the pair of electrodes 2 and 3 in a carbon-contained gas atmosphere. As a result, conductive carbon films 21*a* and 21*b* can be formed on the conductive films 4*a* and 4*b* near the first gap 7 (FIG. 17D). Further, a second gap narrower than the first gap 7 is formed by the carbon films 21*a* and 21*b*. The electron-emitting device is formed through the above steps.

FIG. 16A is a plan view schematically illustrating the electron-emitting device which is subject to the energization activating process. FIG. 16B is a cross-sectional view schematically illustrating a cross section taken along line B-B' of FIG. 16A. In FIGS. 16A and 16B, the same members as those shown in FIGS. 17A to 17D are denoted by the same numbers as those in FIGS. 17A to 17D. In order to allow the electron-emitting device to emit electrons, an electric potential to be applied to one of the electrodes 2 and 3 may be made to be higher than that to be applied to the other electrode. When the voltage is applied to the electrodes 2 and 3 in such a manner, a strong electric field is generated near the second gap 8. As a result, the electrons pass trough a portion, which is an edge of the carbon film (carbon film 21*a* or 21*b*) to be connected to the electrode on the low-potential side of the electrodes 2 and 3 and is an outer edge of the second gap, into the outside (namely, the electrons are emitted).

Japanese Patent Application Laid-Open No. 2002-352699 discloses an electron-emitting device, which is provided with a plurality of conductive films electrically connected to each other in parallel, between the pair of electrodes 2 and 3 (a plurality of conductive films having an electron emitting portion, respectively). Such a configuration can reduce probability of breaking the device due to occurrence of accidental discharge (electron discharge). Specifically, in the electron-emitting device having one conductive film, when the conductive film is broken due to discharge or the like, the device loses the electron emitting function. However, when the electron-emitting device has a plurality of conductive films described above, the device does not lose the electron emitting function unless all the conductive films are broken.

The electron emitting portion can be used for an electron source and an image display apparatus. For example, a plurality of electron-emitting devices is arranged on the substrate, so that an electron source can be configured. Further, an image display apparatus can be configured with an electron-emitting device and a substrate having a light emitting film composed of a phosphor.

Such an image display apparatus is demanded to reduce a fluctuation in luminance for a long period and display a video stably. For this reason, in such an image display apparatus, a variation of an electron emission characteristic among the electron-emitting devices are demanded to be small, and the electron-emitting devices are demanded to be capable of maintaining the electron emission characteristic for a long period (even when the devices are used for a long period, the change in the electron emission characteristic is small).

In order to reduce the variation in the electron emission characteristic among the electron-emitting devices, the following method can be provided. In this method, the plurality of conductive films electrically connected to each other in parallel is formed between the pair of electrodes, and the electron emitting portions are provided to the plurality of conductive films, respectively. In such a configuration, since the plurality of conductive films is electrically connected in parallel, the electron emission characteristic of one device becomes an average of the electron emitting properties of the respective conductive films. As a result, the variation in the electron emission characteristic among the electron-emitting devices can be reduced.

SUMMARY OF THE INVENTION

However, when the electron-emitting device having the plurality of conductive films is driven for a long period, carbons are stacked between the conductive films, and then the conductive films are joined (short-circuit) with the carbons. When all the conductive films are joined, it is equivalent to that one conductive film is present between the pair of electrodes. For this reason, when accidental discharge occurs, the device loses the electron emitting function (point defect). The point defect is a state that the variation in the electron emission characteristic is the largest. Even when accidental device discharge does not occur, namely, when the device is not broken, the variation in the electron emission characteristic among the electron-emitting devices becomes large.

The present invention has been made in view of the above circumstances, and an object thereof is to provide an electron source and an image display apparatus which have electron-emitting devices where a variation in an electron emission characteristic is small and the electron emission characteristic can be maintained for a long period.

There is provided an electron source according to the present invention, having a substrate and a plurality of electron-emitting devices wherein each of the electron-emitting devices has a pair of electrodes provided on the substrate, and a plurality of conductive films having respective electron emitting portions, provided between the pair of electrodes on the substrate so as to be electrically connected to the pair of electrodes, the electron source including: a short-circuit suppressing film which is positioned between the plurality of conductive films and is provided on the electron-emitting device so as to be electrically connected to the pair of electrodes, and mainly contains tungsten (W) and germanium (Ge) nitride, wherein a ratio of the number of tungsten atoms to the number of tungsten and germanium atoms is 0.24 or more in the short-circuit suppressing film, surface resistivity of the short-circuit suppressing film is not less than $1\times10^{10}$ Ω/square and not more than $1\times10^{13}$ Ω/square.

An image display apparatus according to the present invention including: the electron source, and a light-emitting member which emits light due to irradiation with electrons emitted from the electron source.

According to the present invention, the electron source and the image display apparatus, which have the electron-emitting devices where the variation in the electron emission characteristic is small and the electron emission characteristic can be maintained for a long period, can be provided.

Further features of the present invention will become apparent from the following description of exemplary embodiments with reference to the attached drawings.

BRIEF DESCRIPTION OF THE DRAWINGS

FIG. 13 is a diagram illustrating a relationship between a ratio W/(W+Ge) and stability of the electron emission characteristic;

DESCRIPTION OF THE EMBODIMENTS

One example of a configuration of an electron-emitting device according to embodiments is described below. An example of a surface conduction electron-emitting device is described below. Materials and values described below are examples. As the materials and the values, modifications of various materials and values, which are suitable for applications can be adopted within a range of the object and the effect of the present invention.

First Embodiment (Configuration)

Figure 1A:
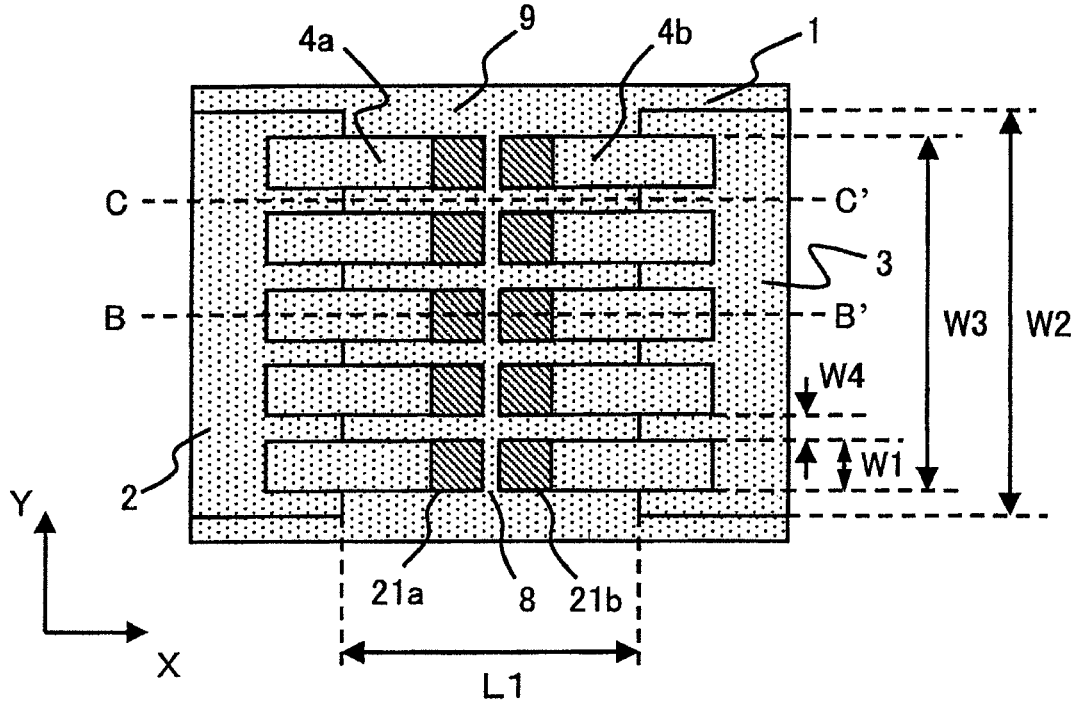
FIG. 1A is a plan view schematically illustrating a configuration of an electron-emitting device according to a first embodiment.
Figure 1B:
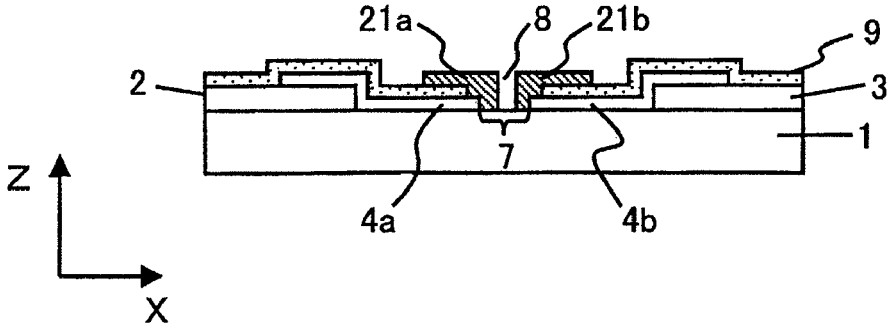
FIGS. 1B and 1C are cross-sectional views taken along lines B-B' and C-C' of FIG. 1A, respectively.
Figure 1C:
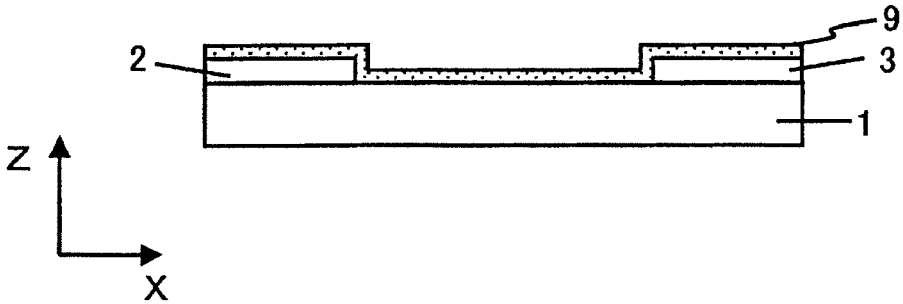

A configuration of the electron-emitting device according to the first embodiment is described with reference to FIGS. 1A to 1C. FIG. 1A is a plan view schematically illustrating a configuration of the electron-emitting device according to the first embodiment. FIGS. 1B and 1C are cross-sectional views taken along lines B-B' and C-C' of FIG. 1A, respectively.

As shown in FIGS. 1A to 1C, a pair of electrodes 2 and 3 is arranged on a substrate 1 so as to be separated from each other by a gap L1. A plurality of conductive films is provided between the pair of electrodes 2 and 3 on the substrate 1. The plurality of conductive films is electrically connected to the pair of electrodes, and has an electron emitting portion, respectively. Specifically, the conductive film having the electron emitting portion is separated into a conductive film 4*a* and a conductive film 4*b* by a first gap 7. The conductive film 4*a* connects the electrode 2 and a carbon film 21*a*, and the conductive film 4*b* connects the electrode 3 and a carbon film 21*b*. The conductive films 4*a* and 4*b* are opposed to each other via the first gap 7, and the carbon films 21*a* and 21*b* are opposed to each other via a second gap 8. The first embodiment describes an example where an opposing direction of the carbon films 21*a* and 21*b* (namely, an opposing direction of the conductive films 4*a* and 4*b*) is approximately parallel with a substrate surface (the surface of the substrate 1; the surface of the substrate 1 where the electrodes 2 and 3 are provided). In the first embodiment, the conductive films 4*a* and 4*b* and the carbon films 21*a* and 21*b* are totally called conductive film having the electron emitting portion. The plurality of conductive films having the electron emitting portions is electrically connected to each other in parallel.

In such an electron-emitting device, a voltage is applied between the conductive films 4*a* and 4*b*, so that electrons are emitted from the carbon film 21*a* or 21*b*. For this reason, portion where the carbon films 21*a* and 21*b* are provided is called electron emitting portion. Specifically, when an electric potential higher than that of the electrode 2 is applied to the electrode 3, electrons are emitted from the portion which is an edge of the carbon film 21*a* and an outer edge of the second gap 8. For this reason, in this case, the carbon film 21*a* connected to the electrode 2 corresponds to an emitter.

After the cost of a driver for driving the electron-emitting device is taken into consideration, a drive voltage of such the electron-emitting device is preferably 30 V or less. Discharge caused by an unexpected voltage fluctuation at the time of driving the device is preferably repressed. After these points are taken into consideration, the width of the second gap 8 is preferable set to not less than 1 nm and not more than 10 nm.

In the example of FIGS. 1A to 1C, the carbon films 21*a* and 21*b* are shown as two films which are completely separated. However, the carbon films 21*a* and 21*b* may be connected on a very small area. When the carbon films 21*a* and 21*b* are connected on the very small area, the area has high resistance, and thus an influence upon the electron emission characteristic is small to be tolerated.

The second gap 8 is preferably has a linear shape as shown in FIG. 1A, but the shape is not limited to the linear shape. The second gap 8 may be bent with specific periodicity, or may have an arc shape. The second gap 8 may have any shape such as a combination of the arc shape and the linear shape.

The second gap 8 can be formed by applying various high-definition nanoscale processing methods such as focused ion beam (FIB) to the conductive films. For this reason, the second gap 8 does not have to be formed by an energization activating process, described later. Further, since the conductive films may be separated without electric connection, the separation is not limited to one using an energization forming process, described later.

However, when the electron-emitting device having the above configuration is continuously driven for a long period, carbons are stacked between the plurality of conductive films having the electron emitting portions, and thus the conductive films are joined (short-circuit) by the carbons. Such short circuit causes the point defect and the variation in the electron emission characteristic.

In the first embodiment, a configuration which represses the accumulation of carbons between the plurality of conductive films is further provided. Specifically, a short-circuit suppressing film 9 mainly containing tungsten (W) and germanium nitride (GeN) is provided on the substrate 1 (on the electron-emitting device) so as to be positioned between the plurality of conductive films and to be electrically connected to the pair of electrodes 2 and 3. Thereafter, the main component of the short-circuit suppressing film 9 is descried as WGeN.

The adoption of such a configuration can provide the electron-emitting device which represses the accumulation of carbons between the plurality of conductive films, and thus represses a fluctuation in an electron emitting amount and can maintain the stable electron emission characteristic for a long period.

Materials and the like of the respective members are described below.

As a material of the substrate 1, a quartz glass, soda lime glass, a glass substrate obtained by laminating silicon oxide (typically, $SiO_2$) on a glass substrate, or a glass substrate from which alkaline component is reduced can be used.

As a material of the electrodes 2 and 3, a conductive material such as metal or a semiconductor can be used. Examples are metal such as Pd, Ni, Cr, Au, Ag, Mo, W, Pt, Ti, Al or Cu, metal oxide (for example, $RuO_2$) and alloy (for example, Pd—Ag).

A gap L1 between the electrodes 2 and 3 and a film thickness of the electrodes 2 and 3 can be suitably designed according to purposes (for example, what the electron-emitting device is used for). For example, when the electron-emitting device is used for an image display apparatus such as a television, described later, they are suitably designed according to display resolution of the image display apparatus. Specifically, since high definition is required for a high-definition (HD) television, a pixel size should be small. For this reason, in order to obtain sufficient luminance with the size of the electron-emitting device being limited, the electron-emitting device is designed so that a sufficient emission current (electron emitting amount) Ie can be obtained. A practical range of the gap L1 is not less than 50 nm and not more than 200 μm, preferably not less than 1 μm and not more than 100 μm.

As the material of the conductive films 4*a* and 4*b*, conductive materials such as metal and a semiconductor can be used. For example, metal such as Pd, Ni, Cr, Au, Ag, Mo, W, Pt, Ti, Al or Cu, metal oxide, metal alloy or carbon can be used.

Rs (sheet resistivity and surface resistivity) of the conductive films 4*a* and 4*b* is preferably not less than $10^2$ Ω/square (Ω/sq) and not more than $10^7$ Ω/sq in order to repress the fluctuation of the electron emitting amount. In order to obtain such resistivity value, the film thickness may be set within a range of not less than 5 nm and not more than 100 nm. Rs is a value which is calculated from R=Rs (l/w) when the resistance R is measured at the time of applying an electric current to the film whose thickness is t, width is w and length is l in a lengthwise direction. Rs can also be calculated according to Rs=ρ/t where resistivity is ρ. The total width W3 of the plurality of conductive films having the electron emitting portions is preferably set so as to be smaller than the width W2 of the electrodes 2 and 3 (see FIG. 1A).

In WGeN which is a main component of the short-circuit suppressing film 9, a ratio of the number of tungsten atoms to the number of tungsten and germanium atoms should be 0.24 or more. When Rs of the short-circuit suppressing film is set to not less than $1\times10^{10}$ Ω/sq and not more than $1\times10^{13}$ Ω/sq, the short-circuit suppressing film can also be provided with a function of an antistatic film. When the ratio is set to 0.50 or less, Rs can be set to not less than $1\times10^{10}$ Ω/sq and not more than $1\times10^{13}$ Ω/sq. Since it is possible but difficult to form the short-circuit suppressing film 9 only on a position between the plurality of conductive films, it is realistic to form the short-circuit suppressing film 9 on the entire surface of the electron-emitting device. When the short-circuit suppressing film 9 is deposited in such a manner, the short-circuit suppressing film 9 covers the electron emitting portions, and when the thickness of the short-circuit suppressing film is too large, the electron emission efficiency is deteriorated. Further, when the short-circuit suppressing film is too thin, the short-circuit suppressing function and the antistatic function cannot be realized. For this reason, the thickness of the short-circuit suppressing film 9 is desirably not less than 3 nm and not more than 20 nm.

(Manufacturing Method)

One example of a method for manufacturing the electron-emitting device according to the first embodiment is described below with reference to FIGS. 2A to 2E. FIGS. 2A to 2E are cross-sectional views similar to that of FIG. 1B.

(Step 1)

Figure 2A:
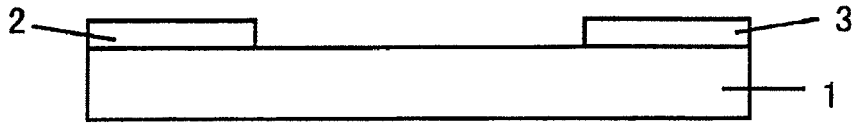
FIGS. 2A to 2E are diagrams illustrating one example of a method for manufacturing the electron-emitting device according to the first embodiment.

The substrate 1 is sufficiently rinsed, and the material for forming the electrodes 2 and 3 is stacked by a vacuum evaporation method, a sputtering method or the like. Patterning is performed by using a photolithography technique or the like so that the electrodes 2 and 3 are formed on the substrate 1 (FIG. 2A).

(Step 2)

Figure 2B:
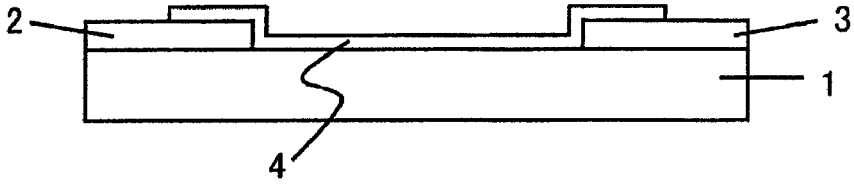

The conductive film 4 is formed between the pair of electrodes 2 and 3 formed on the substrate 1 so as to be electrically connected with the pair of electrodes (FIG. 2B). For example, an organic metal solution is applied to the substrate 1 and is dried, so that an organic metal film is formed. The organic metal film is subject to a heating and baking process so that a metal compound film such as a metal film or a metal oxide film is formed. Thereafter, patterning is performed by a liftoff or etching technique so that the conductive film 4 having a predetermined pattern can be obtained. The method for forming the conductive film 4 is not limited to this. The conductive film 4 can be formed by publicly-known methods such as a vacuum evaporation method, a sputtering method, a CVD method, a dispersion coating method, a dipping method, a spinner method and an ink jet method.

Step 2 and step 1 may be performed in a reverse order. That is to say, after the conductive film 4 is formed, the electrodes 2 and 3 may be formed so as to be electrically connected by using the conductive film 4.

(Step 3)

Figure 2C:
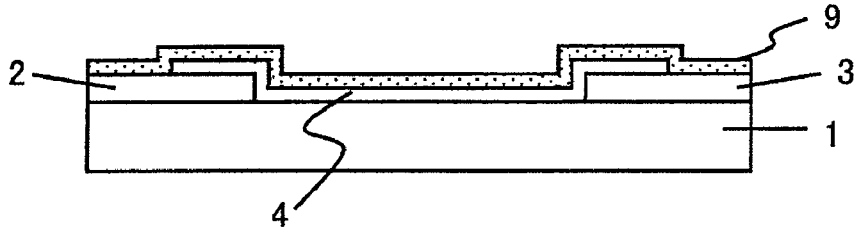

The short-circuit suppressing film 9 is formed on the substrate 1 formed with the conductive film 4 (FIG. 2C). The short-circuit suppressing film 9 can be formed by a known method such as the vacuum evaporation method, the sputtering method, the CVD method, the dispersion coating method, the dipping method, the spinner method or the ink jet method.

(Step 4)

The first gap 7 is formed on the conductive film 4. The first gap 7 can be formed by the patterning method using an EB lithography method. Further, FIB (Focused Ion Beam) is irradiated to a portion of the conductive film 4 where the first gap 7 is desired to be formed so that the first gap 7 can be formed.

Needless to say, the first gap 7 can also be formed by applying an electric current to the conductive film 4 (energization forming process). In order to apply an electric current to the conductive film 4, a voltage (forming voltage) may be applied between the electrodes 2 and 3.

Figure 3A:
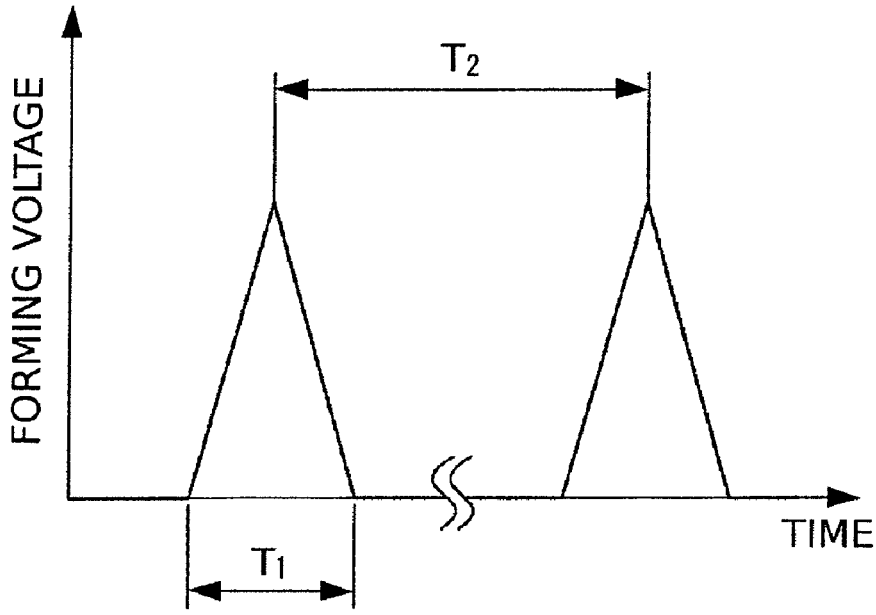
FIGS. 3A and 3B are diagrams illustrating examples of a pulse waveform of a pulse voltage to be applied between a pair of electrodes at the time of executing an energization forming process.

The energization forming process can be executed by repeatedly applying a pulse voltage whose pulse crest value is constant between the electrodes 2 and 3. While the pulse crest value is being gradually increased, the pulse voltage is applied so that the energization forming process can be executed. FIG. 3A illustrates an example of a pulse waveform in the case where the pulse crest value is constant. In FIG. 3A, T1 and T2 are a pulse width (applying time) and a pulse interval (halt time) of the voltage waveform, respectively. For example, T1 may be set to 1 μsec to 10 msec, and T2 may be set to 10 μsec to 100 msec. As the pulse waveform to be applied, a triangular wave or a rectangular wave can be used.

Figure 3B:
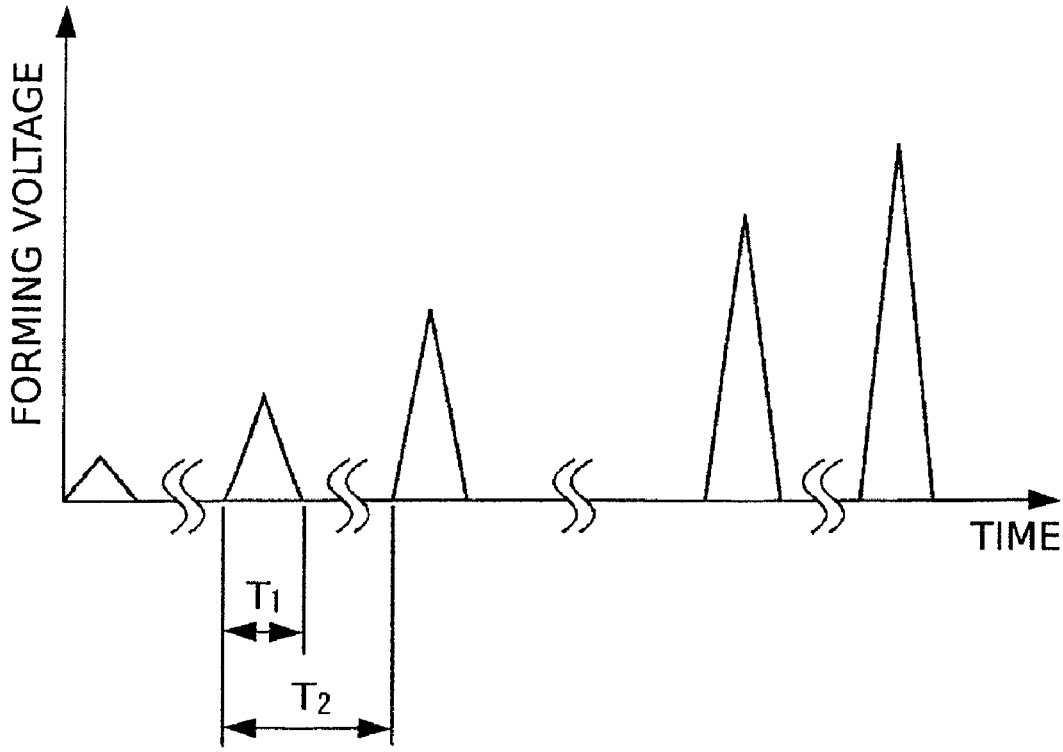

FIG. 3B illustrates an example of the pulse waveform in the case where while the pulse crest value is being increased, the pulse voltage is applied. In FIG. 3B, T1 is the pulse width of the voltage waveform, and T2 is a pulse interval. For example, T1 may be set to 1 μsec to 10 msec, and T2 may be set to 10 μsec to 100 msec. As the pulse waveform to be applied, a triangular wave or a rectangular wave can be used. The crest value of the pulse voltage to be applied may be increased by 0.1 V at each step.

Incidentally, the pulse crest value, the pulse width and the pulse interval are not limited to the above values. These values may be suitably set according to, for example, the resistance of the electron-emitting device or the like so that the first gap 7 is satisfactorily formed.

Figure 2D:
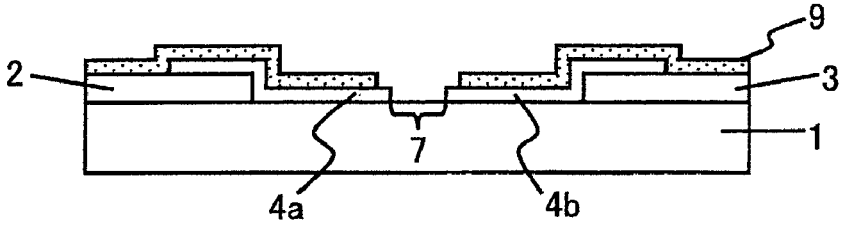

The pair of conductive films 4*a* and 4*b* which is opposed to each other via the first gap 7 is formed at this step (step 4) (FIG. 2D). That is to say, at this step, the conductive films 4 are separated so as not to be electrically connected. The conductive films 4*a* and 4*b* may be connected at a very small portion.

Figure 4:
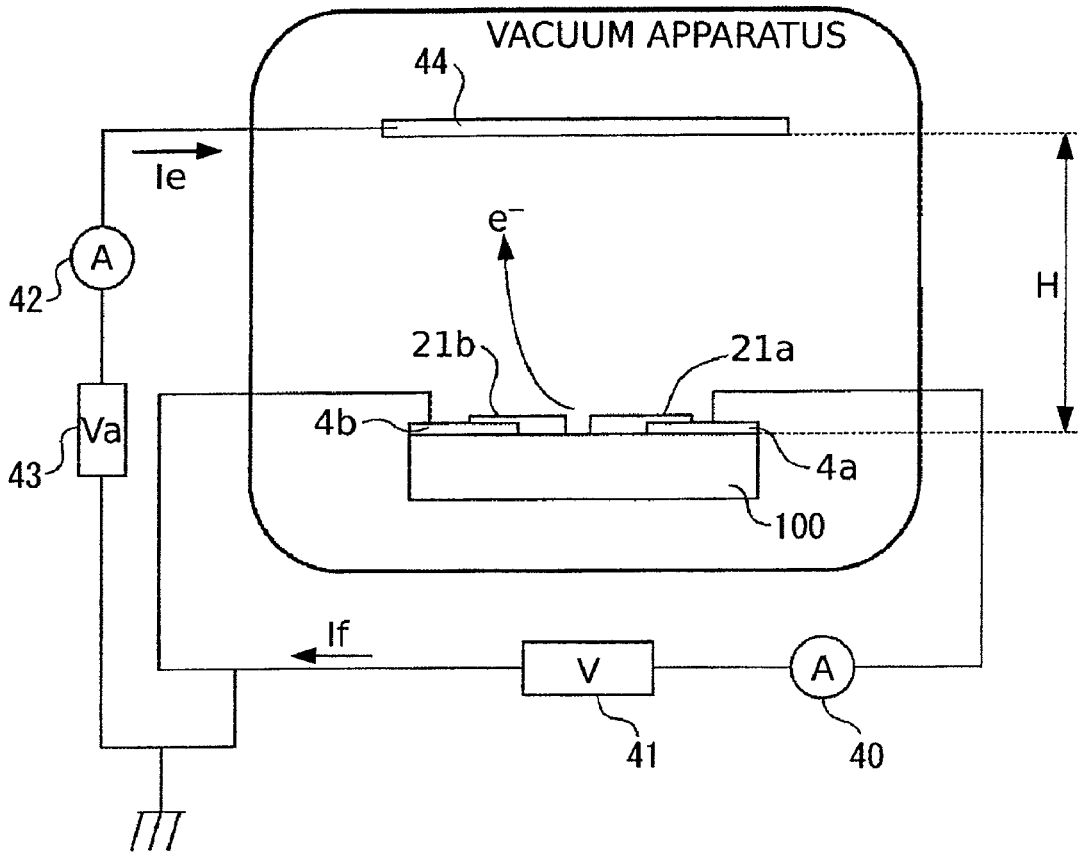
FIG. 4 is a pattern diagram illustrating a measurement evaluating apparatus which measures a property of the electron-emitting device.

The processes following step 4 (for example, the energization forming process and the energization activating process) can be executed after the substrate 1 which has been subject to steps 1 to 3 is arranged in the measurement evaluating apparatus shown in FIG. 4 and the inside is evacuated.

The measurement evaluating apparatus shown in FIG. 4 has a vacuum apparatus (vacuum chamber), and the vacuum apparatus includes a device which is necessary for the vacuum apparatus such as an air displacement pump or a vacuum meter and the like, not shown. Various measurement evaluations are made inside the vacuum apparatus under desired vacuum (for example, measurement of a device current and an emission current, described later).

A gas introducing apparatus, not shown, is provided to the measurement evaluating apparatus. As a result, carbon-contained gas to be used for the energization activating process, described later, can be introduced into the vacuum apparatus with a desired pressure. Further, the entire vacuum apparatus and the substrate 1 arranged in the vacuum apparatus can be heated by a heater, not shown.

(Step 5)

Figure 2E:
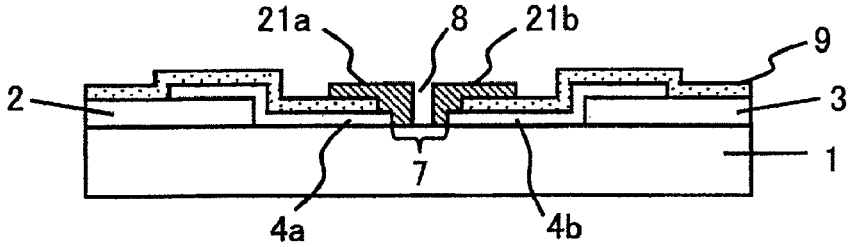

The device is subject to the energization activating process (FIG. 2E).

Figure 5A:
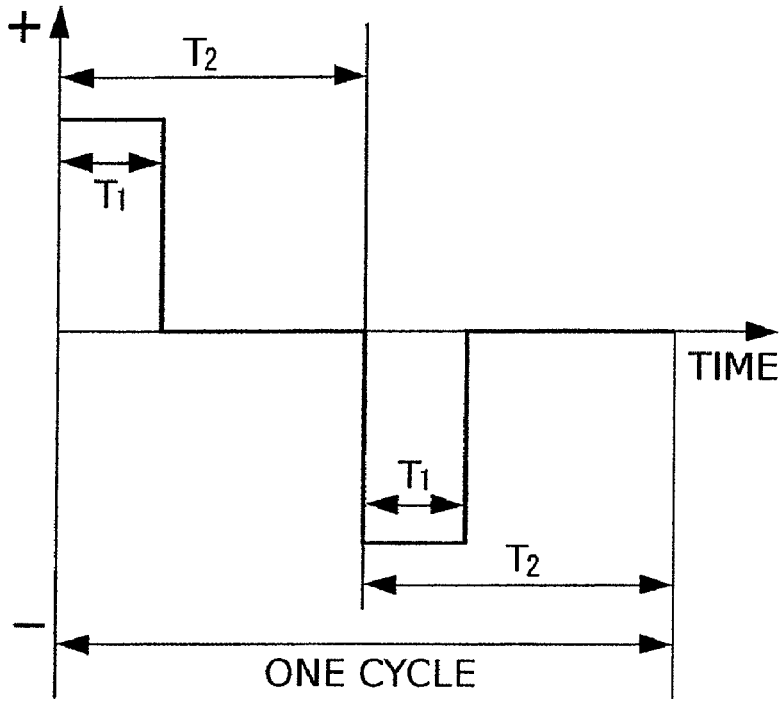
FIGS. 5A and 5B are diagrams illustrating examples of a pulse waveform of the pulse voltage to be applied between the pair of electrodes at the time of executing an energization activating process.
Figure 5B:
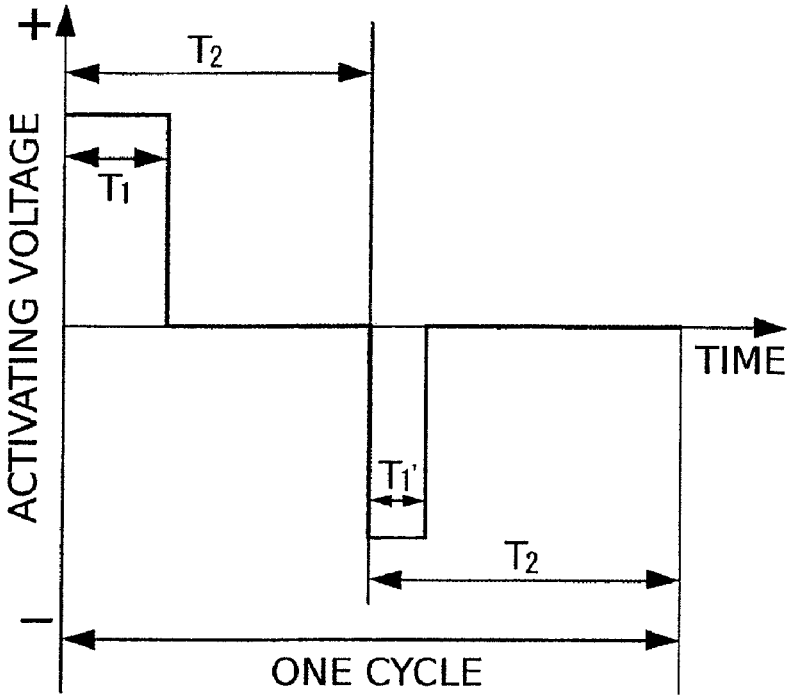

The energization activating process is executed by introducing carbon-contained gas into the vacuum apparatus shown in FIG. 4 and applying a bipolar pulse voltage (activating voltage) as shown in FIGS. 5A and 5B between the electrodes 2 and 3 at a plurality of times under a carbon-contained gas atmosphere. That is to say, the bipolar pulse voltage is applied between the conductive films 4*a* and 4*b* at a plurality of times.

The carbon films 21*a* and 21*b* can be provided on the substrate 1 by the above process. Specifically, the carbon films 21*a* and 21*b* are stacked on the substrate 1 between the conductive films 4*a* and 4*b* and on the conductive films 4*a* and 4*b* near the substrate 1. As a result, the second gap 8 is formed. That is to say, at this step, the conductive film having the electron emitting portion is formed.

An organic substance gas can be used as the carbon-contained gas. Examples of the organic substance include aliphatic hydrocarbon (for example, alkane, alkene, and alkyne), aromatic hydrocarbon, alcohol, aldehyde, ketone, amine, and organic acid (for example, phenol, carvone, and sulfone). Specifically, saturated hydrocarbon such as methane, ethane or propane expressed by $C_nH_{2n+2}$, or unsaturated hydrocarbon such as ethylene or propylene expressed by $C_nH_{2n}$ can be used. Further, benzene, toluene, methanol, ethanol, formaldehyde, acetaldehyde, acetone, methyl ethyl ketone, methylamine, ethylamine, phenol, formic acid, acetic acid, propionic acid and the like can be used. Particularly, tolunitrile is preferably used.

The electron-emitting device shown in FIGS. 1A to 1C is manufactured through above steps 1 to 5.

The manufactured electron-emitting device is preferably heated in a vacuum before it is driven (before the light-emitting member is irradiated with electron beams in the case where the device is used in the image display apparatus). The heating process is called a stabilizing process. When the stabilizing process is executed, excessive carbon and organic substances, which adhere to the surface of the substrate 1 or the other portions by the energization activating process, can be removed. Specifically, while the device is being heated, excessive carbons and organic substances are evacuated from the vacuum apparatus (the display panel in the case where the device is used in the image display apparatus). The organic substances are desirably evacuated as much as possible from the vacuum apparatus. Specifically, it is preferable that they are evacuated until partial pressure of the organic substances becomes $1\times10^{-8}$ Pa or less. The total pressure in the vacuum container including gas other than the organic substances is preferably $3\times10^{-6}$ Pa or less.

After the stabilizing process is executed, the atmosphere at this time is preferably maintained. As a result, a sufficiently stable property can be maintained. When the organic substances are sufficiently removed, the pressure may be slightly raised.

The above method for manufacturing the electron-emitting device is only an example, and the electron-emitting device according to the first embodiment is not limited to the electron emitting devices manufactured by the above method.

Second Embodiment (Configuration)

Figure 6A:
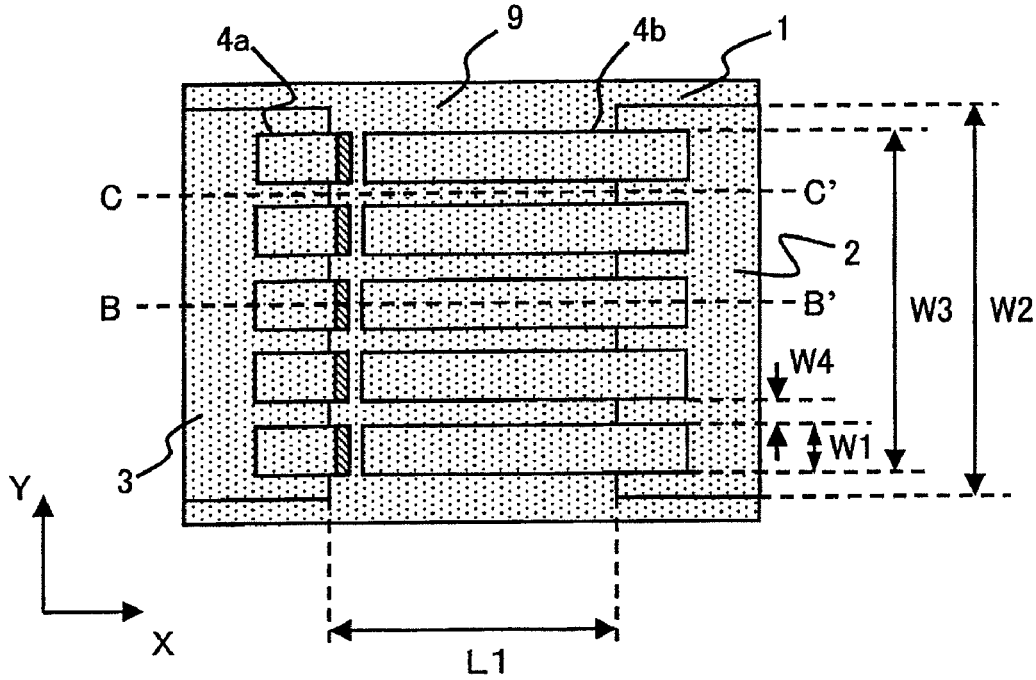
FIG. 6A is a plan view schematically illustrating a configuration of the electron-emitting device according to a second embodiment.
Figure 6B:
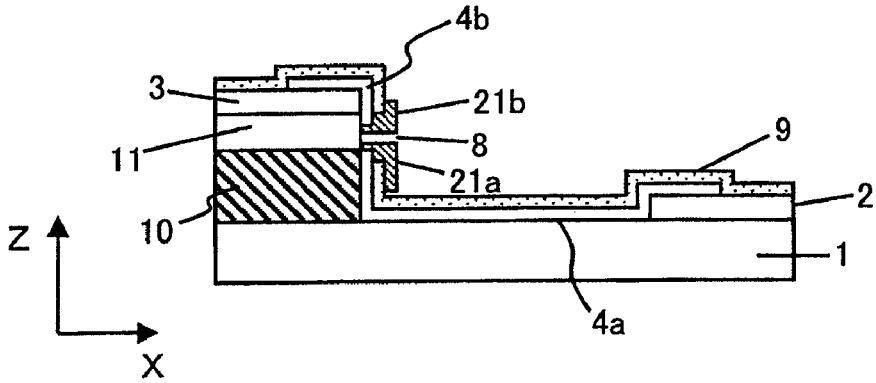
FIGS. 6B and 6C are cross-sectional views taken along lines B-B' and C-C' of FIG. 6A, respectively.
Figure 6C:
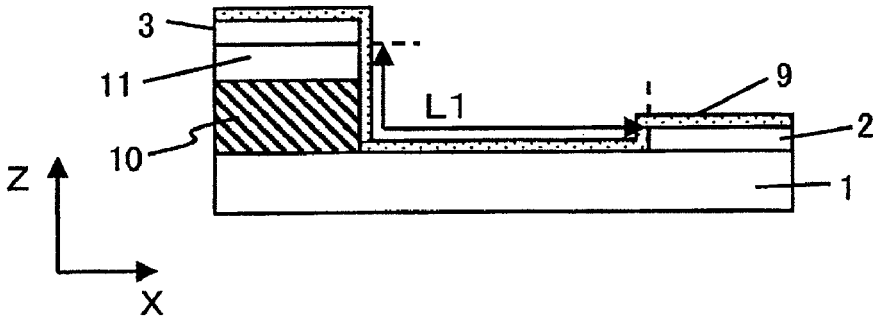

A configuration of the electron-emitting device according to a second embodiment is described below with reference to FIGS. 6A to 6C. FIG. 6A is a plan view schematically illustrating the electron-emitting device according to the second embodiment. FIGS. 6B and 6C are cross-sectional views taken along lines B-B' and C-C' of FIG. 6A, respectively. In FIGS. 6A to 6C, the members which are the same as those described in the first embodiment are denoted by the same numbers. Further, since the size of L1, materials and sizes of the respective members in the electron-emitting device according to the second embodiment are similar to those described in the first embodiment, the description thereof will not be repeated.

The second embodiment is an example where an opposing direction of the carbon films 21*a* and 21*b* has an angle (preferably perpendicular) with respect to the substrate surface. Specifically, in the second embodiment, a side surface of a laminator provided with the second gap 8 is substantially perpendicular to the substrate surface. In the first embodiment, the opposing direction of the carbon films 21*a* and 21*b* is parallel with the substrate surface (X direction). However, it is preferable that the opposing direction of the carbon films 21*a* and 21*b* is perpendicular to the substrate surface. When the opposing direction of the carbon films 21*a* and 21*b* is perpendicular to the substrate surface, electron emission efficiency $\eta$ can be improved.

Electrons emitted from the electron-emitting device according to the second or first embodiment are accelerated towards an anode electrode 44 and collide there as shown in FIG. 4 by applying a voltage to the anode electrode 44 provided to a position separated from the substrate surface to a Z direction. The electron emission efficiency $\eta$ is a value expressed by emission current Ie/device current If. The emission current Ie is an electric current applied to the anode electrode 44, and the device current If is an electric current applied between the electrodes 2 and 3.

For this reason, when the opposing direction of the carbon films 21*a* and 21*b* faces the anode electrode 44 like the second embodiment, the electron emission efficiency $\eta$ can be heightened. Specifically, the angle formed between the side surface of the laminator provided with the second gap 8 and the substrate surface is preferably not less than 30° and not more than 90°, and preferably substantially 90°.

In the electron-emitting device according to the second embodiment, the carbon film closer to the substrate 1 is used as the electron emitter. That is to say, in the example shown in FIGS. 6A to 6C, a voltage is applied between the electrodes 2 and 3 so that the carbon film 21*a* connected to the electrode 2 becomes the electron emitter. Specifically, the electric potential higher than that of the electrode 2 is applied to the electrode 3.

As shown in FIG. 6, the laminator provided with the second gap 8 is composed of an activation accelerating layer 11 and a high thermal conductive layer 10 whose thermal conductivity is higher than that of the activation accelerating layer 11. With such a configuration, the first gap 7 can be formed on a predetermined position (position of the activation accelerating layer) at the energization forming process.

As a material of the activation accelerating layer 11, $SiO_2$ is preferably used. As a material of the high thermal conductive layer 10, a material whose thermal conductivity is higher than that of the activation accelerating layer 11 is used. Specifically, silicon nitride, alumina, aluminum nitride, tantalum pentoxide, or titanium oxide and the like can be used.

(Manufacturing Method)

The method for manufacturing the electron-emitting device according to the second embodiment is described below with reference to FIGS. 7A to 7G.

(Step 1)

Figure 7A:
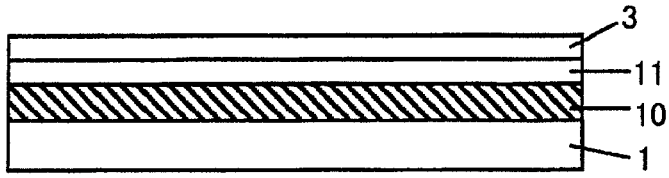
FIGS. 7A to 7G are diagrams illustrating one example of a method for manufacturing the electron-emitting device according to the second embodiment.

A material composing the high thermal conductive layer 10, a material composing the activation accelerating layer 11 and a material composing the electrode 3 are sequentially laminated on the sufficiently rinsed substrate 1 (FIG. 7A). These layers are laminated on the substrate 1 by the vacuum evaporation method, the sputtering method, or the CVD method.

(Step 2)

Figure 7B:
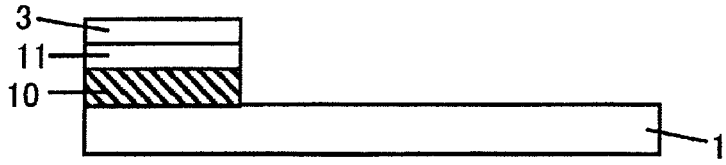

The laminated three layers are patterned into a desired shape by using the photolithography technique, so that the laminator and the electrode 3 positioned on the laminator are formed (FIG. 7B).

(Step 3)

Figure 7C:
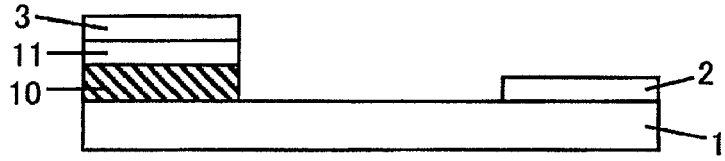

The electrode 2 is formed on the substrate 1 (FIG. 7C). The electrode 2 may be formed by the vacuum evaporation method, the sputtering method, or the CVD method. The electrode 2 may be suitably patterned by using the photolithography technique.

(Step 4)

Figure 7D:
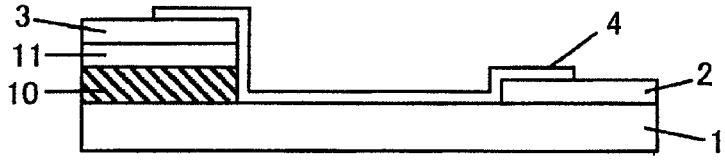

The conductive film 4 is formed so as to cover the side surface of the laminator and connect the electrodes 2 and 3 (FIG. 7D). The conductive film 4 may be formed similarly to step 2 in the first embodiment.

(Steps 5 to 7)

Figure 7E:
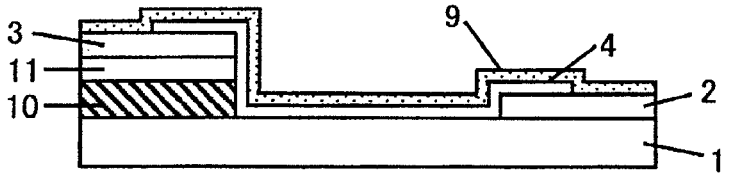
Figure 7F:
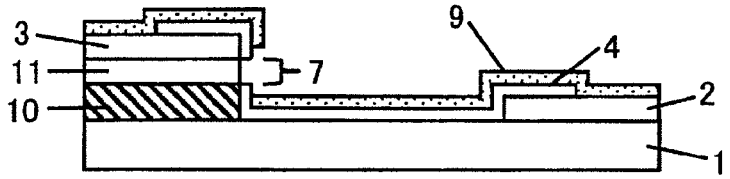
Figure 7G:
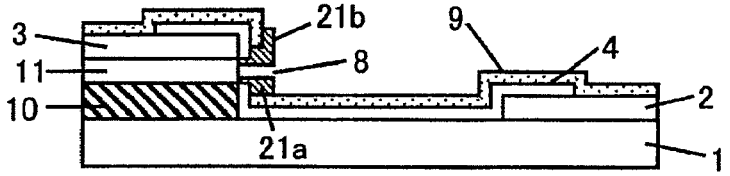

Processes similar to steps 3 to 5 in the first embodiment are executed as steps 5 to 7 (FIGS. 7E, 7F and 7G).

The electron-emitting device shown in FIGS. 6A to 6C is manufactured through above steps 1 to 7.

The method for manufacturing the electron-emitting device is only an example, and the electron-emitting device according to the second embodiment is not limited to the electron-emitting device manufactured by this method.

<Practical Application>

A practical application of the electron-emitting device according to the first and second embodiments is described below.

A plurality of electron-emitting devices is arranged on the substrate, so that the electron source or the image display apparatus such as a flat panel television can be composed.

(Electron Source)

A plurality of electron-emitting devices is arranged on the substrate so that the electron source can be configured. The arrangement form of the electron-emitting devices on the substrate includes a matrix arrangement. In this arrangement form, the electrode 2 is electrically connected to one of m X-direction wirings arranged on the substrate. The electrode 3 is electrically connected to one of n Y-direction wirings in the arranged on the substrate. Both m and n are positive integers.

Figure 8:
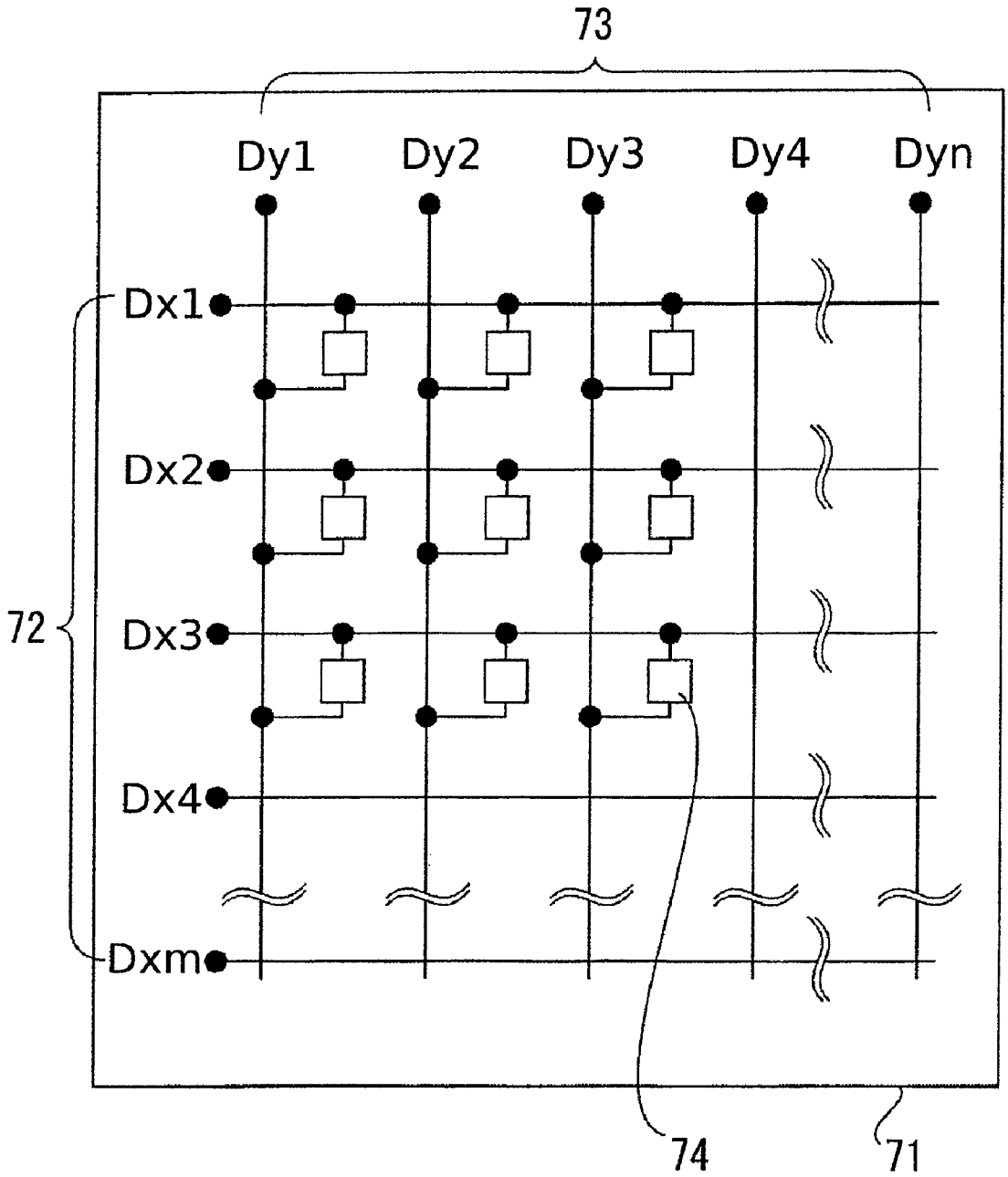
FIG. 8 is a diagram illustrating one example of a configuration of a matrix-arrangement electron source (electron source substrate)

A configuration of the matrix-arrangement electron source (electron source substrate) is described below with reference to FIG. 8.

The m X-direction wirings Dx1, Dx2, . . . , Dxm are formed on an insulating substrate 71 by the vacuum evaporation method, the printing method or the sputtering method. The X-direction wirings are composed of a conductive material such as metal. The n Y-direction wirings Dy1, Dy2, . . . Dyn can be formed by the similar method and with the similar material to those of the X-direction wiring. An insulating layer, not shown, is provided between the m X-direction wirings and the n Y-direction wirings (intersection portions). The insulating layer can be formed by the vacuum evaporation method, the printing method and the sputtering method.

The X-direction wirings are electrically connected to a scanning signal application unit, not shown, which applies a scanning signal. On the other hand, the Y-direction wirings are electrically connected to a modulation signal generating unit, not shown, which applies a modulation signal for modulating an amount of electrons emitted from each of the selected electron-emitting devices in synchronization with the scanning signal. A difference voltage between the scanning signal and the modulation signal is applied as a drive voltage Vf to the electron-emitting devices.

(Image Display Apparatus)

Figure 9:
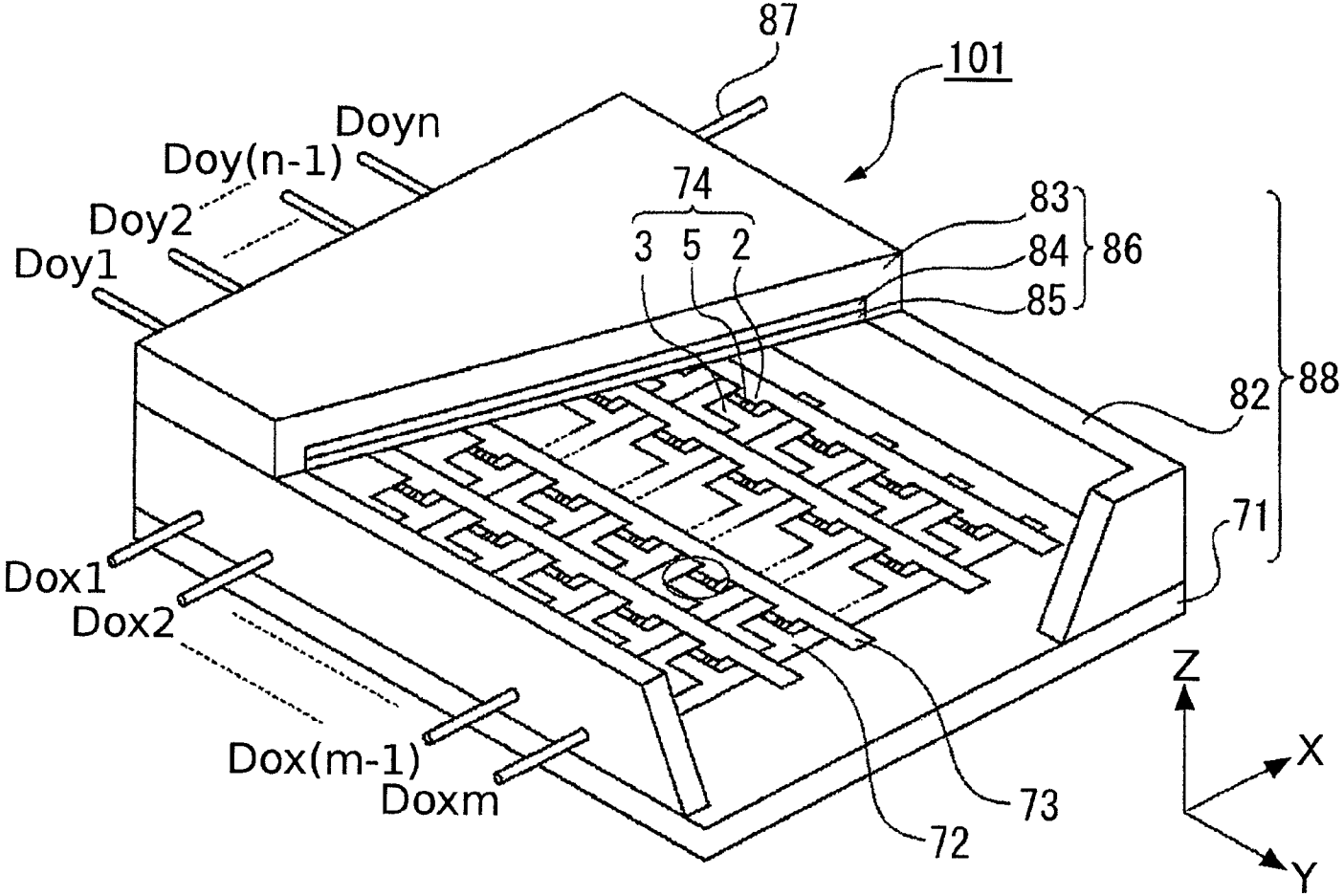
FIG. 9 is a pattern diagram illustrating a configuration of an envelope composing the image display apparatus.
Figure 10A:
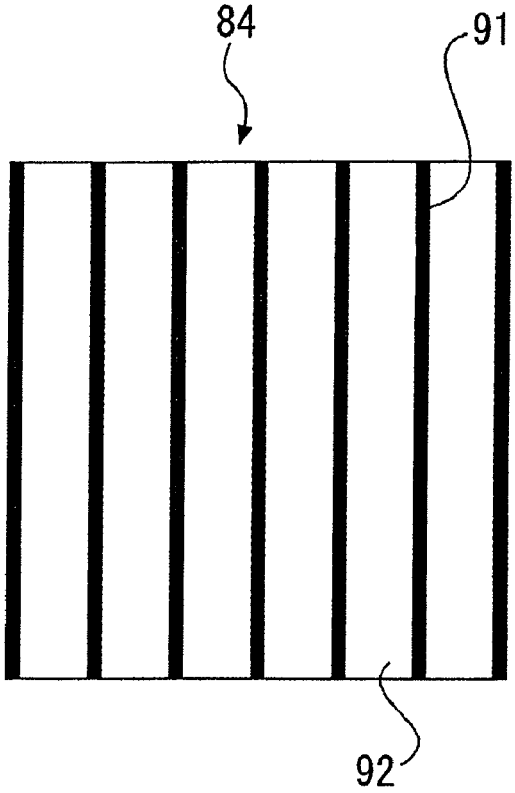
FIGS. 10A and 10B are pattern diagrams illustrating a configuration of a phosphor film.
Figure 10B:
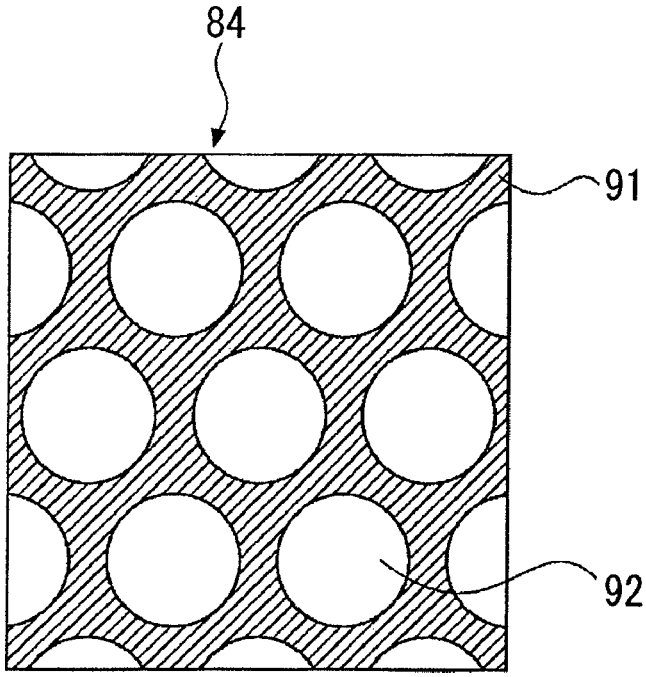

The electron source and the light-emitting member which emits light due to the irradiation with the electrons emitted from the electron source can compose the image display apparatus. One example of the image display apparatus using the matrix-arranged electron sources is described below with reference to FIGS. 9, 10A and 10B. FIG. 9 is a pattern diagram illustrating a configuration of an envelope 88 (display panel) composing the image display apparatus. FIGS. 10A and 10B are pattern diagrams illustrating a configuration of the phosphor film having the light-emitting member (phosphor).

As shown in FIG. 9, the envelope 88 is generally composed of a face plate 86, an electron source substrate, and a supporting frame 82. The face plate 86 is provided so as to be opposed to the electron source. The supporting frame 82 is arranged between the face plate 86 and a rear plate (insulating substrate 71). A joint portion of the rear plate and the supporting frame 82 and a joint portion of the face plate 86 and the supporting frame 82 are sealed by adhesive such as frit glass or indium.

A supporting body called a spacer, not shown, may be disposed between the face plate 86 and the rear plate 71. As a result, the envelope 88 having sufficient strength against air pressure can be configured.

The face plate 86 is composed of a transparent substrate 83 such as glass, a phosphor film 84, and a conductive film 85 (metal back). Specifically, the phosphor film 84 and the conductive film 85 (metal back) are sequentially laminated on an inner surface of the transparent substrate 83. The phosphor film 84 and the conductive film 85 are described below.

FIGS. 10A and 10B illustrate one example of a concrete configuration of the phosphor film 84. In the case of monochrome, the phosphor film 84 is composed of only a monochromatic phosphor 92. When the color image display apparatus is configured, the phosphor film 84 includes the phosphors 92 of three primary colors RGB, and light absorbing members 91 arranged between the phosphors of the respective colors. As the light absorbing members 91, a black member can be preferably used. FIG. 10A illustrates a form that the light absorbing members 91 are arranged into a stripe pattern. FIG. 10B illustrates a form that the light absorbing member 91 is arranged into a matrix pattern. In general, the form of FIG. 10A is called black stripe, and the form of FIG. 10B is called black matrix. An object to provide the light absorbing members 91 is to make color mixing or the like on three-toned portions among the phosphors 92 of the three primary colors unnoticeable, and repress deterioration of the contrast due to external light reflection from the phosphor film 84. As a material of the light absorbing members 91, a material mainly containing black lead is generally used. The material of the light absorbing members 91 is not limited to the material mainly containing black lead. The material may be a conductive or insulating material as long as the material has less light transmission and reflection.

When the conductive film 85 is provided, light directing to the electron-emitting device 74 side of light emitted from the phosphors 92 can be specula-reflected towards the transparent substrate 83, thereby improving the luminance. Further, the conductive film 85 can function as an anode electrode (namely, an anode electrode 44 shown in FIG. 4) for applying a voltage for accelerating electron beams, and can repress a damage of the phosphor due to collision of negative ions generated in the envelope 88.

The conductive film 85 is preferably formed by an aluminum film. The conductive film 85 is formed by giving a smoothing process (normally, called filming) to a surface of the formed phosphor film 84 and then depositing Al according to vacuum evaporation.

In order to heighten the conductivity of the phosphor film 84, the face plate 86 may be provided with a transparent electrode (not shown) made of ITO between the phosphor film 84 and the transparent substrate 83.

The m X-direction wirings are connected to terminals Dox1 to Doxm for connection to external devices, respectively. The n Y-direction wirings are connected to terminals Doy1 to Doyn for connection to the external devices, respectively. Voltages are applied from corresponding terminals of the terminals Dox1 to Doxm and Doy1 to Doyn to the electron-emitting devices 74. When the voltages to be applied to the terminals (voltages to be applied to the electron-emitting devices) are controlled, electrons can be emitted from the desired electron-emitting devices 74. At this time, a voltage of not less than 5 kV and not more than 30 kV, preferably not less than 10 kV and not more than 25 kV is applied to the metal back from a high-voltage terminal 87. A gap between the face plate 86 and the substrate 71 is set to not less than 1 mm and not more than 5 mm, preferably not less than 1 mm and not more than 3 mm. As a result, the electrons emitted from the selected electron-emitting devices transmit through the metal back and collide with the phosphor film 84, so that the phosphor 92 is excited and emits light. As a result, an image is displayed.

In the above configuration, the materials of the members and detailed portions are not limited to the above contents, and they may be suitably changed according to purposes.

Example 1

As an example 1, a concrete example of the electron-emitting device described in the first embodiment is described with reference to FIGS. 2A to 2E.

(Step 1)

A quartz substrate for the substrate 1 is sufficiently rinsed. Ti with thickness of 5 nm is formed on the quartz substrate by the sputtering method, and Pt with thickness of 40 nm is formed on Ti. Thereafter, Ti and Pt are patterned into a desired shape by using the photolithography technique, so that Ti and Pt layers are formed as the electrodes 2 and 3 on the substrate 1 (FIG. 2A). At this time, the gap L1 between the electrodes 2 and 3 is set to 100 μm, and the width W2 of the electrodes 2 and 3 is set to 500 μm.

(Step 2)

An organic palladium compound solution is spin-coated between the pair of electrodes 2 and 3 formed on the substrate 1 so as to be connected to the pair of the electrodes. Thereafter, the organic palladium compound solution is subject to the heating and baking process. Specifically, the substrate which is coated with the organic palladium compound solution is heated. As a result, one conductive film mainly containing Pd is formed. The conductive film is patterned by the photolithography technique using a stepper, so that the plurality of conductive films 4 electrically connected to the electrodes 2 and 3, respectively, is formed (FIG. 2B).

At this time, the width W1 of the conductive films 4 is set to 1 μm. The distance W4 between the adjacent conductive films 4 is set to the same value as the width W1. A total width W3 of the plurality of conductive films 4 is set to 179 μm. That is to say, the number of the conductive films 4 is 90 (=(179+W1)/(2×W1)). A film thickness of the formed conductive films 4 is 10 nm, and its Rs (sheet resistivity) is $1\times10^4$ Ω/sq.

(Step 3)

A film composed of W (tungsten) and GeN (germanium nitride) (mixture film) is formed as the short-circuit suppressing film 9 on the substrate 1 formed with the plurality of conductive films 4 by the sputtering method (FIG. 2C). Specifically, the mixture film is formed by a high-frequency magnetron sputtering apparatus according to a binary sputtering method using a tungsten target and a germanium target. Film forming conditions are as follows.

Air pressure: 1.5 Pa
Atmosphere: mixed atmosphere of argon and nitrogen
Argon flow rate: 50 sccm
Nitrogen flow rate: 9 sccm
Electric power supplied to the tungsten target: 230 W
Electric power supplied to the germanium target: 800 W
Discharge time: 40 sec The film thickness of the formed mixture film is 10 nm, and Rs (sheet resistivity) is $8\times10^{10}$ Ω/sq. Further, a ratio of the number of tungsten atoms to the number of tungsten and germanium atoms in the obtained mixture film is 0.32 (=W/(W+Ge)).

(Step 4)

The substrate 1 which undergoes steps 1 to 3 is placed in the vacuum apparatus in FIG. 4, and the vacuum apparatus is evacuated by an air displacement pump. After a degree of vacuum reaches $1\times10^{-6}$ Pa, a voltage Vf is applied between the electrodes 2 and 3 by the power source 41, so that the energization forming process is executed. As a result, the first gap 7 is formed on the respective conductive films 4. That is to say, each of the conductive films 4 is separated into the conductive films 4*a* to 4*b* (FIG. 2D).

A voltage waveform shown in FIG. 3B is used for the forming process. Specifically, T1 in FIG. 3B is 1 msec, T2 is 16.7 msec, and a crest value of a triangular wave is raised by step of 0.1 V so that the energization forming process is executed. During the forming process, a resistance measurement pulse voltage of 0.1 V is applied between the electrodes 2 and 3 periodically, so that resistance is measured. The energization forming process is ended at the time point when the measured resistance becomes about 1 MΩ or more.

(Step 5)

The device which is subject to step 4 is subject to the energization activating process. Specifically, tolunitrile is introduced into the vacuum apparatus. Then, the maximum voltage value is set to ±20 V and T1 is set to 1 msec and T2 is set to 10 msec, and a pulse voltage with a waveform shown in FIG. 5A is applied between the electrodes 2 and 3. The energization activating process is executed until the device current (If) rises gently. As a result, the carbon films 21*a* and 21*b* are formed (FIG. 2E).

The electron-emitting device according to the example 1 is manufactured through the above steps.

(Step 6)

The manufactured electron-emitting device is subject to the stabilizing process. Specifically, while the vacuum apparatus and the electron-emitting device are being heated and maintained at about 250° C., the vacuum apparatus is continuously evacuated. After 20 hours, the heating using a heater is stopped, and the vacuum apparatus is returned to room temperature. As a result, the degree of vacuum in the vacuum apparatus reaches about $1\times10^{-8}$ Pa.

The electron-emitting device is driven and the emission current Ie is measured for a long time by the measurement evaluating apparatus shown in FIG. 4. Specifically, a distance H between the anode electrode 44 and the electron-emitting device is set to 2 mm, and an electric potential of 5 kV is applied to the anode electrode 44 by the high-voltage power source 43. A rectangular pulse voltage whose crest value is 17 V, pulse width is 100 μs and frequency is 60 Hz is applied between the electrodes 2 and 3 of the electron-emitting device by using the power source 41.

Figure 11:
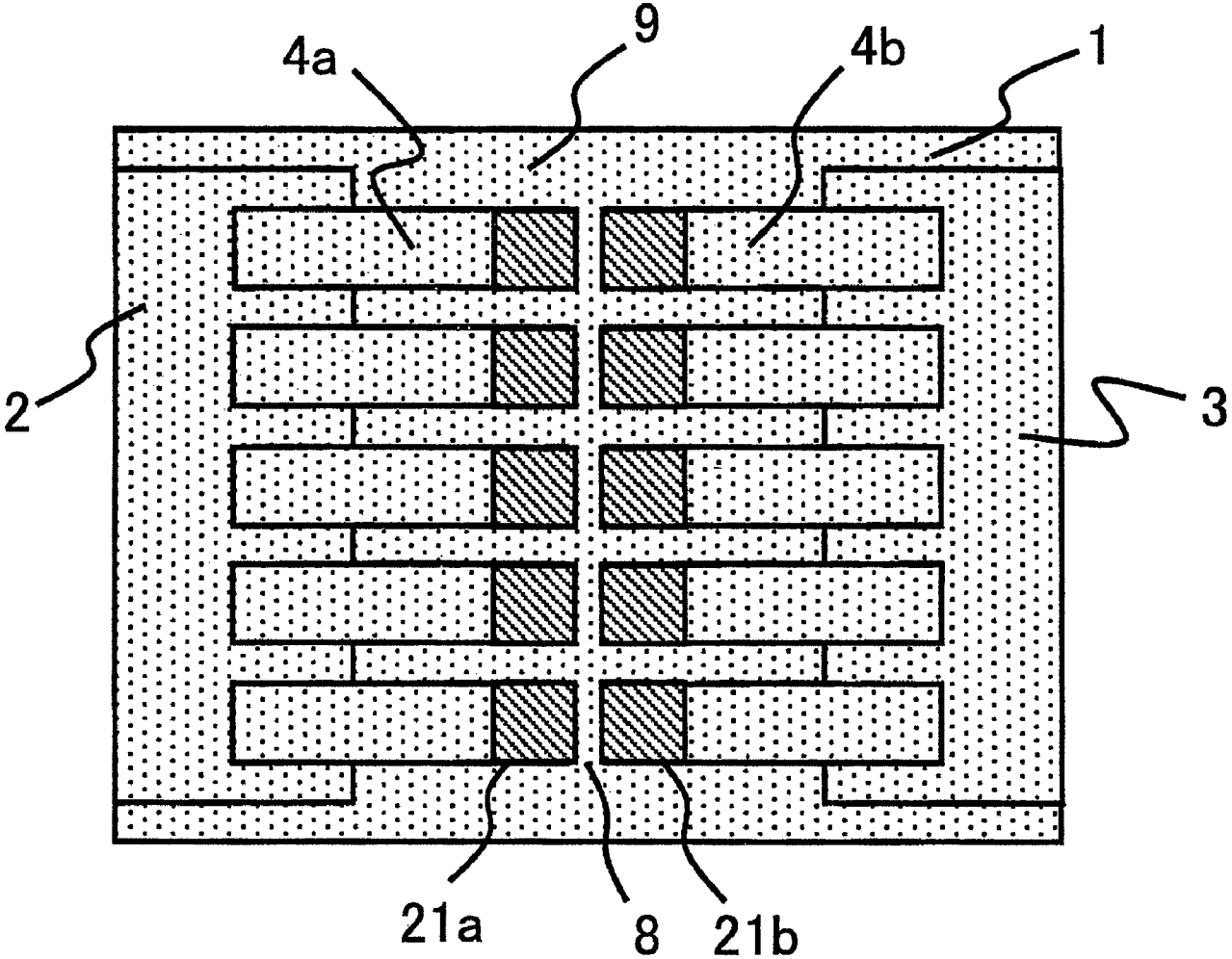
FIG. 11 is a pattern diagram illustrating a state after the electron-emitting device according to an example 1 is driven for a long period.

When an electron emitting point of the electron-emitting device is observed during drive, independent electron emitting points are observed on the plurality of electron emitting portions, and short circuit between the conductive films (electron emitting portions) is not seen. After the electron-emitting device is driven for a long time, the electron-emitting device is taken out so as to be observed by SEM. As a result, as shown in FIG. 11, the deposition of carbons to be the electron emitting portion is not recognized between the conductive films having the electron emitting portions. Further, as a result of manufacturing and evaluating a plurality of devices similarly, the similar evaluated results are obtained from these devices.

Comparative Example 1

A comparative example 1 describes a case where the electron-emitting device has the similar configuration to that in the example 1 and has a short-circuit suppressing film of different composition. Description about the steps and materials similar to those in the example 1 will not be repeated.

As steps 1 and 2, the processes similar to steps 1 and 2 in the example 1 are executed so that the substrate 1 formed with the electrodes 2 and 3 and the plurality of conductive films 4 is manufactured.

(Step 3)

Similarly to step 3 in the example 1, the mixture film composed of tungsten and germanium nitride is formed as the short-circuit suppressing film 9 on the substrate 1 formed with the plurality of conductive films 4 by the binary sputtering method. The mixture film is formed by using the same apparatus as that in the example 1. The film forming conditions are as follows.

Air pressure: 1.5 Pa
Atmosphere: mixed atmosphere of argon and nitrogen
Argon flow rate: 50 sccm
Nitrogen flow rate: 6 sccm
Electric power supplied to the tungsten target: 180 W
Electric power supplied to the germanium target: 800 W
Discharge time: 40 sec The film thickness of the formed mixture film is 10 nm, and Rs (sheet resistivity) is $7\times10^{10}$ Ω/sq. Further, a ratio of the number of tungsten atoms to the number of tungsten and germanium atoms in the obtained mixture film is 0.09 (=W/(W+Ge)).

As steps 4 and 5, the processes similar to steps 4 and 5 in the example 1 are executed so that an electron-emitting device is manufactured. At step 6, the manufactured electron-emitting device is subject to the stabilizing process similarly to step 6 in the example 1.

The electron-emitting device is driven and the emission current Ie is measured for a long time by the measurement evaluating apparatus shown in FIG. 4. Specifically, a distance H between the anode electrode 44 and the electron-emitting device is set to 2 mm, and an electric potential of 5 kV is applied to the anode electrode 44 by the high-voltage power source 43. A rectangular pulse voltage whose crest value is 17 V, pulse width is 100 μs and frequency is 60 Hz is applied between the electrodes 2 and 3 of the electron-emitting device by using the power source 41.

Figure 12:
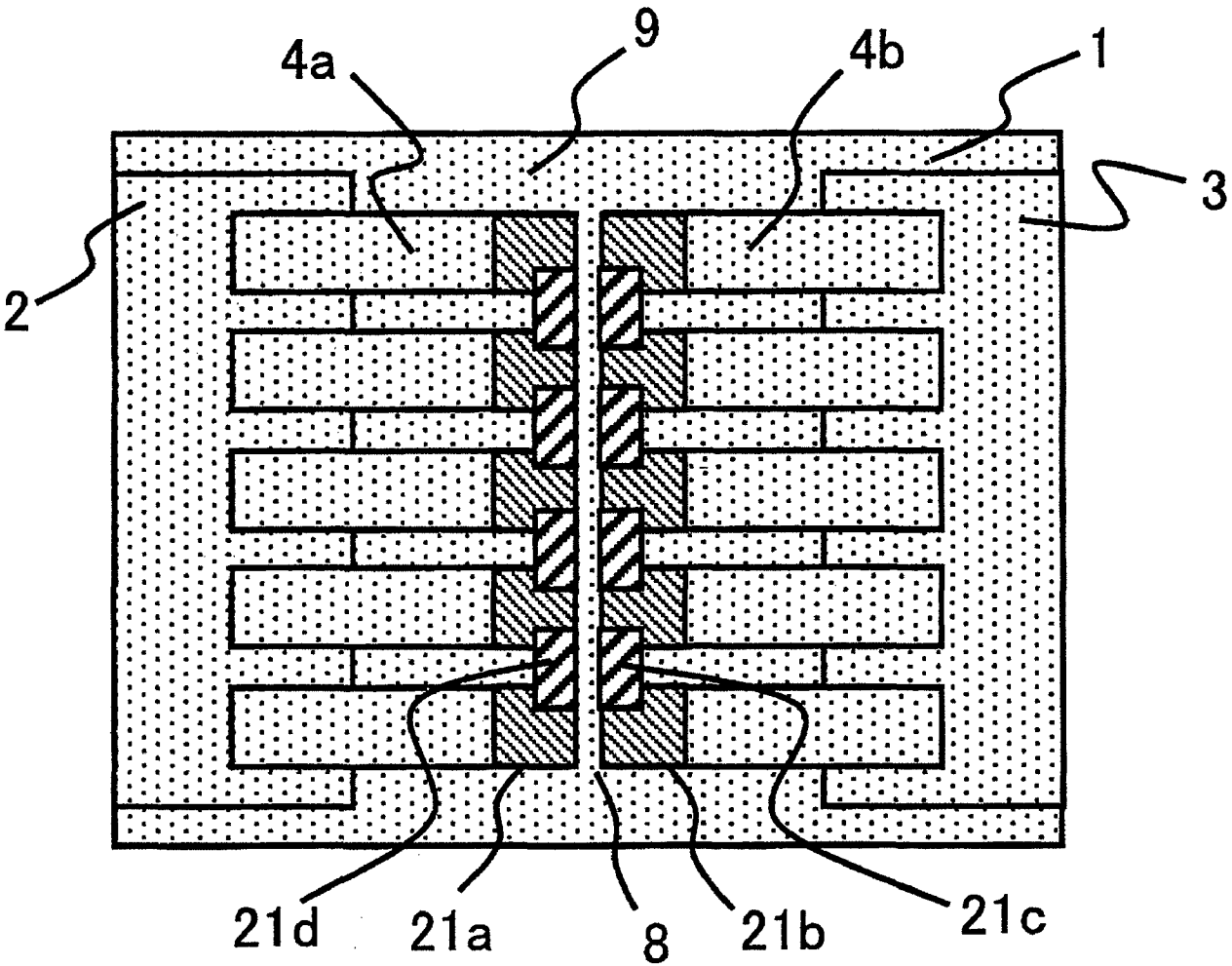
FIG. 12 is a pattern diagram illustrating a state after the electron-emitting device according to a comparative example 1 is driven for a long period.

When an electron emitting point of the electron-emitting device is observed during drive, an electron emitting point is observed on positions other than the electron emitting portions just after the manufacturing, and short circuit between the conductive films is seen. After the electron-emitting device is driven for a long time, the electron-emitting devise is taken out so as to be observed by SEM. As a result, as shown in FIG. 12, carbons 21*c* and 21*d* are stacked between the conductive films having the electron emitting portions, and a gap due to the carbons which cause electron emission is formed.

FIG. 13 illustrates a relationship between the ratio W/(W+Ge) and the stability of the electron emission property when the film forming conditions of the mixture film composed of tungsten and germanium nitride (the nitrogen flow rate, the electric power applied to the tungsten target and the electric power applied to the germanium target) are variously changed.

As to the evaluations of the stability of the electron emission properties, "A" means that the stability is very satisfactory, "B" means that the stability is insufficient, and "C" means that the stability is not good. Specifically, "A" means that the stacked carbons are not joined on all the plurality of conductive films. "B" means that the stacked carbons are joined on some of the conductive films. "C" means that the stacked carbons are joined on all the conductive films. As a result, in WGeN as a main component of the short-circuit suppressing film, the ratio of the number of tungsten atoms to the number of tungsten and germanium atoms should be 0.24 or more.

In any cases, when the surface resistivity of the short-circuit suppressing film is less than $1\times10^{10}$, the electron emission efficiency is deteriorated, and the electron emission characteristic is fluctuated by heat generation on the electron-emitting device. Further, when the surface resistivity exceeds $1\times10^{13}$, a fluctuation in the electron beam arriving position due to charging of the substrate surface around the electron-emitting devices is confirmed. When the image display apparatus is formed by using such an electron source (the electron source which has the plurality of electron-emitting devices having the short-circuit suppressing film whose surface resistivity is less than $1\times10^{10}$ or larger than $1\times10^{13}$), a shift of bright spots is visually confirmed, and thus a satisfactory display image cannot be obtained. That is to say, the surface resistivity of the short-circuit suppressing film should be not less than $1\times10^{10}$ and not more than $1\times10^{13}$.

Example 2

As an example 2, a concrete example of the electron-emitting device described in the second embodiment is described with reference to FIGS. 7A to 7G.

(Step 1)

A quartz substrate for the substrate 1 is sufficiently rinsed. $Si_3N_4$ is formed as a material of the high thermal conductive layer 10 on the entire surface of the quartz substrate by a plasma CVD method. The quartz substrate and $Si_3N_4$ are sequentially stacked on another substrate for measuring the thermal conductivity, and the thermal conductivity of the laminator in a laminated direction is measured. As a result, the thermal conductivity at room temperature is 25 W/m·K.

Silicon oxide ($SiO_2$) as the material of the activation accelerating layer 11 is formed on the entire surface of the high thermal conductive layer 10 by the plasma CVD method. $SiO_2$ is further stacked on the substrate for measuring the thermal conductivity, and the thermal conductivity of the laminator in a laminated direction is measured. As a result, the thermal conductivity at room temperature is 1.4 W/m·K.

Ti with thickness of 5 nm and Pt with thickness of 40 nm are sequentially formed as the materials of the electrode 3 on the entire surface of the activation accelerating layer 11 (FIG. 7A).

(Step 2)

Spin coating of photoresist and exposure and development of a mask pattern are performed, so that the laminator composed of the high thermal conductive layer 10 and the activation accelerating layer 11, and the electrode 3 arranged on the laminator are formed by dry etching (FIG. 7B).

(Step 3)

The photoresist is peeled, and spin-coating of photoresist, exposure and development of mask pattern are again performed, so that photoresist having an opening corresponding to the pattern of the electrode 2 is formed. Ti with thickness of 5 nm and Pt with thickness of 40 nm are sequentially stacked in the opening. Thereafter, the photoresist is lifted off so that the electrode 2 is formed (FIG. 7C).

In the example 2, the width W2 of the electrodes 2 and 3 is set to 500 μm. The film thickness of the high thermal conductive layer 10 is set to 500 nm. The film thickness of the activation accelerating layer 11 is set to 50 nm. The gap L1 between the electrodes 2 and 3 (in the example 2, the gap L1 is a length between the electrode 2 and the electrode 3 along the high thermal conductive layer 10 and the activation accelerating layer 11 and the surface of the substrate 1 (see FIG. 6C)) is set to 100 μm.

(Step 4)

An organic palladium compound solution is spin-coated between the pair of electrodes 2 and 3 formed on the substrate 1 so as to be connected to the pair of electrodes. Thereafter, the organic palladium compound solution is subject to the heating and baking process. As a result, one conductive film mainly containing Pd is formed. The conductive film is patterned by the photolithography technique using a stepper, so that a plurality of conductive films 4 electrically connected to the electrodes 2 and 3, respectively, is formed (FIG. 7D).

At this time, the width W1 of the conductive films 4 is set to 1 μm. The gap W4 between the adjacent conductive films 4 is set to the same value as the width W1. The total width W3 of the plurality of conductive films 4 is set to 179 μm. That is to say, the number of the conductive films 4 is 90 (=(179+W1)/(2×W1)). The film thickness of the formed conductive films 4 is set to 10 nm, and their Rs (sheet resistivity) is $1\times10^4$ Ω/sq.

Since steps thereafter are similar to steps 3 to 5 in the example 1, the description thereof will not be repeated. The electron-emitting device according to the example 2 is manufactured through the above steps. The manufactured electron-emitting device is subject to the stabilizing process similarly to step 6 in the example 1.

The electron-emitting device is driven and the emission current Ie is measured for a long time by using the measurement evaluating apparatus shown in FIG. 4. Specifically, the distance H between the anode electrode 44 and the electron-emitting device is set to 2 mm, and an electric potential of 5 kV is applied to the anode electrode 44 by the high-voltage power source 43. A rectangular pulse voltage whose crest value is 17 V, pulse width is 100 μs and frequency is 60 Hz is applied between the electrodes 2 and 3 of the electron-emitting device by using the power source 41.

Figure 14:
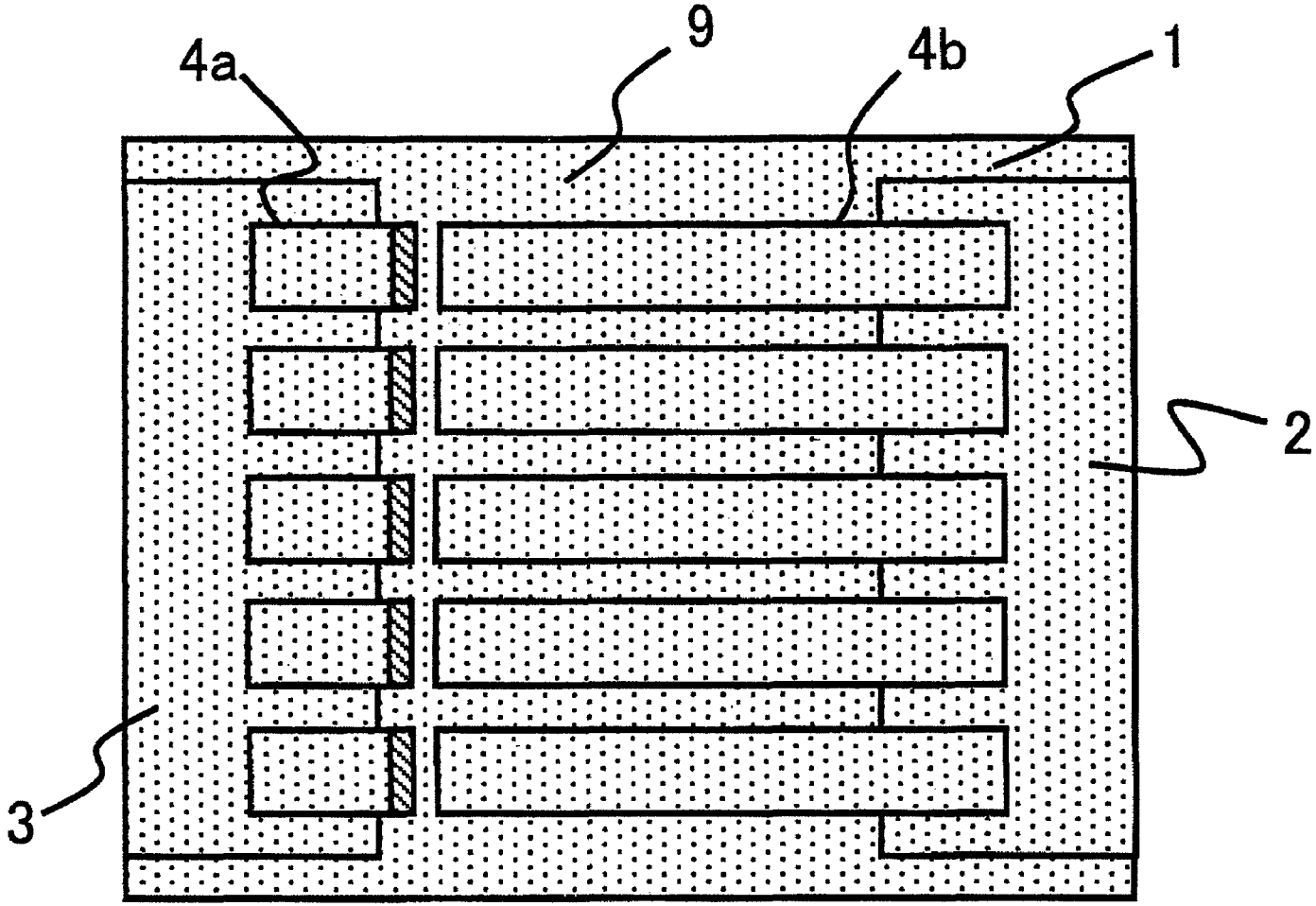
FIG. 14 is a pattern diagram illustrating a state after the electron-emitting device according to an example 2 is driven for a long period.

When an electron emitting point of the electron-emitting device is observed during drive, independent electron emitting points are observed on the plurality of electron emitting portions, and the short circuit between the conductive films is not seen. After the electron-emitting device is driven for a long time, the electron-emitting device is taken out so as to be observed by SEM. As a result, as shown in FIG. 14, adhesion of carbons causing an electron emitting source is not seen between the conductive films. As a result of manufacturing and evaluating the plurality of devices similarly, the similar evaluated result can be obtained from any devices.

Comparative Example 2

A comparative example 2 describes a case where the electron-emitting device has the similar configuration to that in the example 2 and has a short-circuit suppressing film of different composition. Description about the steps and materials similar to those in the example 2 will not be repeated.

As steps 1 to 4, the processes similar to steps 1 to 4 in the example 2 are executed so that the substrate 1 formed with the high thermal conductive layer 10, the activation accelerating layer 11, the electrodes 2 and 3 and the plurality of conductive films 4 is manufactured.

(Step 5)

Similarly to step 5 in the example 2 (step 3 in the example 1), the mixture film composed of tungsten and germanium nitride is formed as the short-circuit suppressing film 9 on the substrate 1 formed with the plurality of conductive films 4 by the binary sputtering method. The mixture film is formed by using the same apparatus as that in the example 2. The film forming conditions are as follows.

Air pressure: 1.5 Pa

Atmosphere: mixed atmosphere of argon and nitrogen

Argon flow rate: 50 sccm

Nitrogen flow rate: 6 sccm

Electric power supplied to the tungsten target: 180 W

Electric power supplied to the germanium target: 800 W

Discharge time: 40 sec

The film thickness of the formed mixture film is 10 nm, and Rs (sheet resistivity) is $7\times10^{10}$ Ω/sq. Further, a ratio of the number of tungsten atoms to the number of tungsten and germanium atoms in the obtained mixture film is 0.09 (=W/(W+Ge)).

Since steps thereafter are similar to those in the example 2, namely, similar to steps 4 and 5 in the example 1, description thereof will not be repeated. The electron-emitting device according to the comparative example 2 is manufactured through the above steps. The manufactured electron-emitting device is subject to the stabilizing process similarly to step 6 in the example 1.

The electron-emitting device is driven and the emission current Ie is measured for a long time by using the measurement evaluating apparatus shown in FIG. 4. Specifically, the distance H between the anode electrode 44 and the electron-emitting device is set to 2 mm, and an electric potential of 5 kV is applied to the anode electrode 44 by the high-voltage power source 43. A rectangular pulse voltage whose crest value is 17 V, pulse width is 100 μs and frequency is 60 Hz is applied between the electrodes 2 and 3 of the electron-emitting device by using the power source 41.

Figure 15:
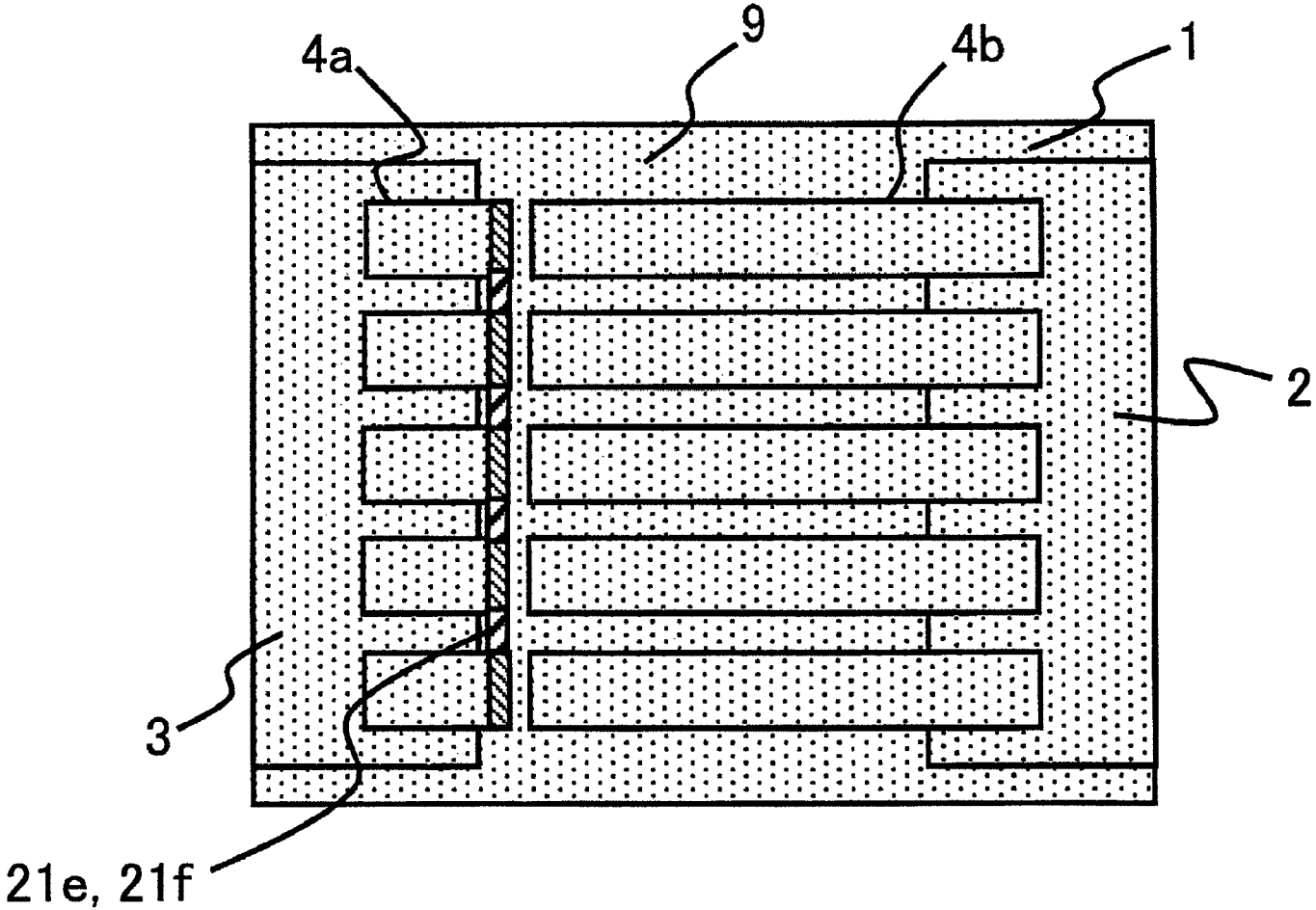
FIG. 15 is a pattern diagram illustrating a state after the electron-emitting device according to a comparative example 2 is driven for a long period.
Figure 16A:
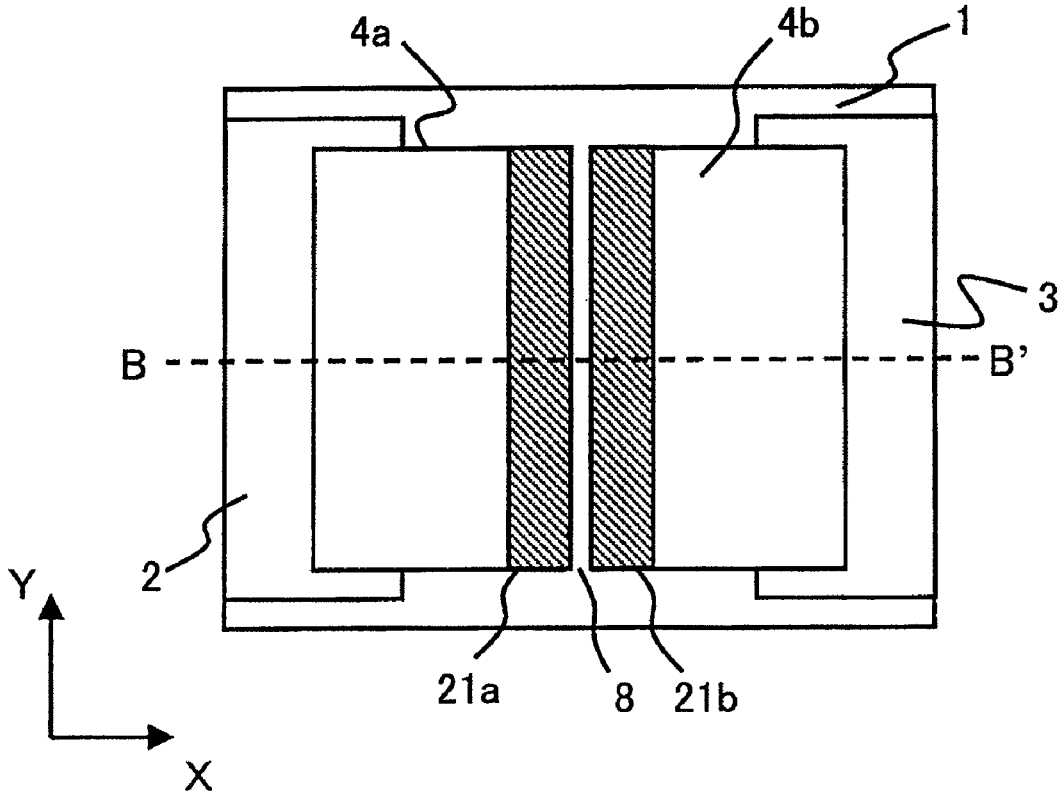
FIG. 16A is a plan view schematically illustrating a configuration of a conventional electron-emitting device.
Figure 16B:
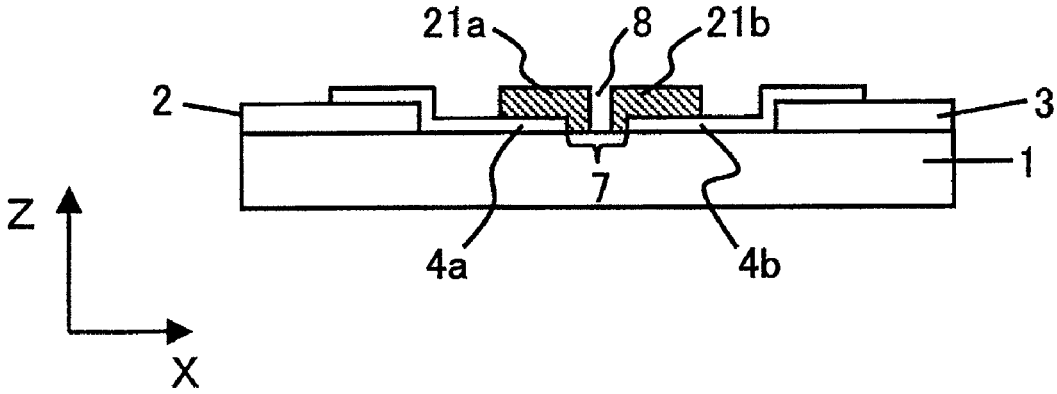
FIG. 16B is a cross-sectional view taken along line B-B' of FIG. 16A.
Figure 17A:
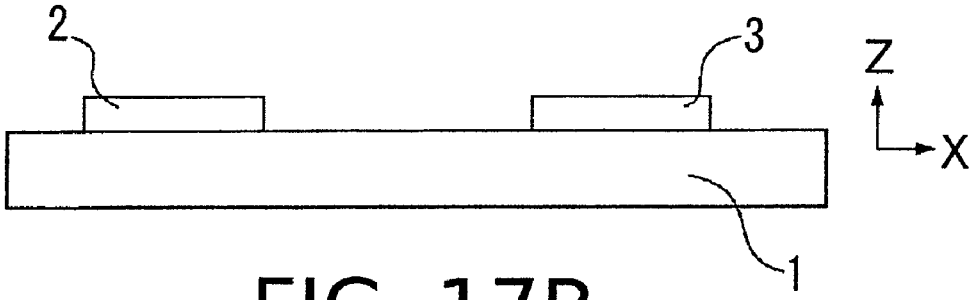
FIGS. 17A to 17D are diagrams illustrating a method for manufacturing the conventional electron-emitting device.
Figure 17B:
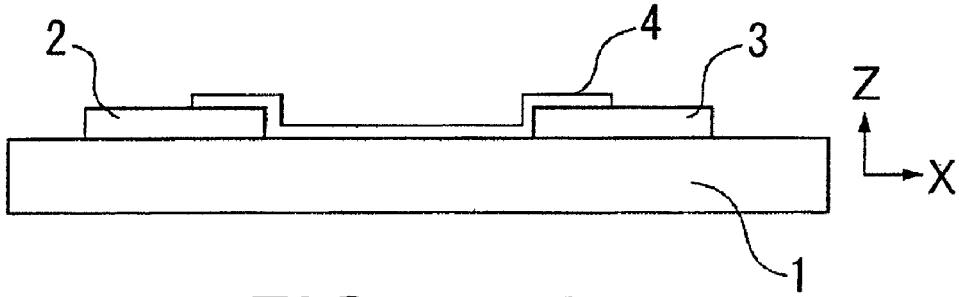
Figure 17C:
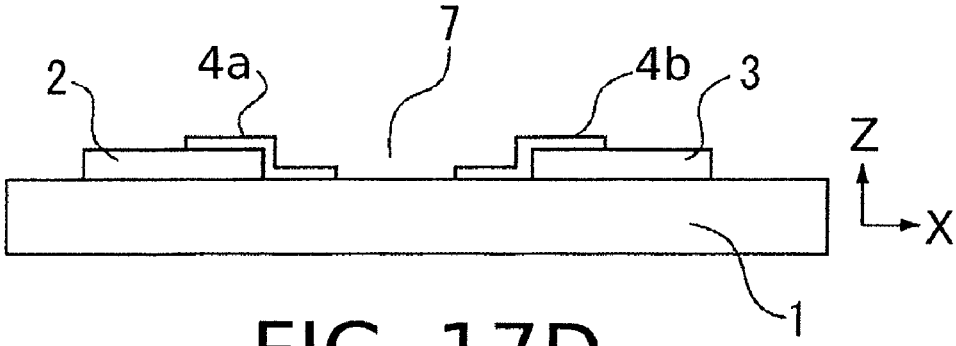
Figure 17D:
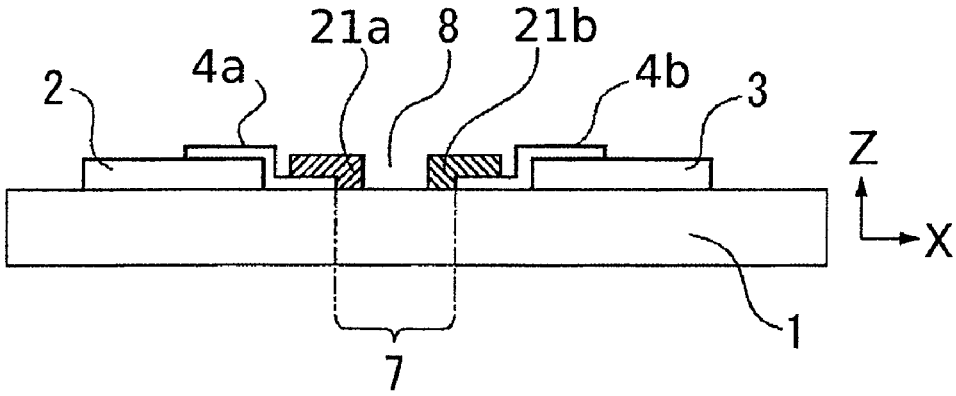

When an electron emitting point of the electron-emitting device is observed during drive, an electron emitting point is observed on positions other than the electron emitting portions just after manufacturing, and the short circuit between the conductive films is seen. After the electron-emitting device is driven for a long time, the electron-emitting device is taken out so as to be observed by SEM. As a result, as shown in FIG. 15, carbons 21*e* and 21*f* are stacked between the conductive films having the electron emitting portions. As a result, gaps due to the carbons causing electron emission are formed.

In the electron-emitting device having the configuration shown in FIG. 6A to 6C (namely, the electron-emitting device having the configuration of the example 2 and the comparative example 2), the short-circuit suppressing film requires the similar conditions to those of the electron-emitting device having the configuration shown in FIGS. 1A to 1C. That is to say, in WGeN as the main component of the short-circuit suppressing film, the ratio of the number of tungsten atoms to the number of tungsten and germanium atoms should be 0.24 or more. Further, the surface resistivity of the short-circuit suppressing film should be not less than $1\times10^{10}$ and not more than $1\times10^{13}$.

When the electron-emitting device has the above configuration, the variation in the electron emission characteristic is small, and the electron emission characteristic can be maintained for a long period. As a result, the electron source and the image display apparatus having such electron-emitting devices can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-230765, filed on Sep. 9, 2008, which is hereby incorporated by reference herein in its entirety.

What is claimed is:

1. An electron source having a substrate and a plurality of electron-emitting devices, wherein each of the electron-emitting devices has a pair of electrodes provided on the substrate, and a plurality of conductive films having respective electron emitting portions, provided between the pair of electrodes on the substrate so as to be electrically connected to the pair of electrodes, the electron source comprising:

a short-circuit suppressing film which is positioned between the plurality of conductive films and is provided on the electron-emitting device so as to be electrically connected to the pair of electrodes, and mainly contains tungsten (W) and germanium (Ge) nitride, wherein a ratio of the number of tungsten atoms to the number of tungsten and germanium atoms is 0.24 or more in the short-circuit suppressing film, surface resistivity of the short-circuit suppressing film is not less than $1\times10^{10}$ Ω/square and not more than $1\times10^{13}$ Ω/square.

2. An electron source according to claim 1, wherein the electron-emitting device is a surface conduction electron-emitting device.

3. An electron source according to claim 1, wherein the ratio of the number of tungsten atoms to the number of tungsten and germanium atoms is 0.50 or less in the short-circuit suppressing film.

4. An electron source according to claim 1, wherein a film thickness of the short-circuit suppressing film is not less than 3 nm and not more than 20 nm.

5. An image display apparatus comprising: an electron source according to claim 1, and a light-emitting member which emits light due to irradiation with electrons emitted from the electron source.

* * * * *